US008862028B2

(12) United States Patent
Fujii

(10) Patent No.: US 8,862,028 B2
(45) Date of Patent: Oct. 14, 2014

(54) IMAGE FORMATION UNIT AND IMAGE FORMATION APPARATUS

(75) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 351 days.

(21) Appl. No.: 13/239,967

(22) Filed: Sep. 22, 2011

(65) Prior Publication Data

US 2012/0076549 A1 Mar. 29, 2012

(30) Foreign Application Priority Data

Sep. 27, 2010 (JP) ..... 2010-214937

(51) Int. Cl.
*G03G 15/08* (2006.01)
*G03G 21/16* (2006.01)

(52) U.S. Cl.
CPC ..... *G03G 21/1647* (2013.01); *G03G 21/1676* (2013.01); *G03G 2215/066* (2013.01); *G03G 2215/0673* (2013.01)
USPC ..... 399/119; 399/262

(58) Field of Classification Search
CPC ..... G03G 21/1647; G03G 2215/066; G03G 2215/0673; G03G 21/1676; G03G 21/1842; G03G 2221/1654
USPC ..... 399/119, 262, 268
See application file for complete search history.

(56) References Cited

U.S. PATENT DOCUMENTS

2005/0271425 A1* 12/2005 Shimomura et al. ..... 399/258

FOREIGN PATENT DOCUMENTS

JP 2006-276233 A 12/2006
JP 2008-209865 A 9/2008

* cited by examiner

*Primary Examiner* — David Gray
*Assistant Examiner* — Sevan A Aydin
(74) *Attorney, Agent, or Firm* — Marvin A. Motsenbocker; Mots Law, PLLC

(57) ABSTRACT

An image formation unit includes a developer container containing developer therein, an image formation device configured to form a developer image using the developer, a first engagement part provided at the image formation device, a second engagement part movably provided at the developer container, and a regulation member. The second engagement part is movable between an unengaged position and an engaged position with respect to the first engagement part. The regulation member regulates movement of the second engagement part in the state where the second engagement part is in the engaged position.

21 Claims, 26 Drawing Sheets

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2010-214937 filed on Sep. 27, 2010, entitled "IMAGE FORMATION UNIT AND IMAGE FORMATION APPARATUS", the entire contents of which are incorporated herein by reference.

BACKGROUND OF THE INVENTION

1. Field of the Invention

The present disclosure relates to an image formation unit and an image formation apparatus configured to form an image.

2. Description of Related art

An image formation unit provided in an conventional image formation apparatus includes an image formation device and a developer container that can be separated. The developer container is replaced every time when the developer container runs out of developer so as to continue printing, until the end of the life of the image formation device (see for example, Japanese Patent Application Laid-Open No. 2008-209865).

SUMMARY OF THE INVENTION

A first aspect of the invention is an image formation unit including: a developer container containing developer therein; an image formation device configured to form a developer image with the developer; a first engagement part provided at the image formation device; a second engagement part movably provided at the developer container, the second engagement part being movable between an unengaged position where the second engagement part is not engaged with the first engagement part and an engaged position where the second engagement part is engaged with the first engagement part; and a regulation member configured to regulate movement of the second engagement part in the state where the second engagement part is in the engaged position.

A second aspect of the invention is an image formation unit including: a developer container containing developer therein; an image formation device configured to form a developer image with the developer; a first engagement part provided at the image formation device; a second engagement part movably provided at the developer container, the second engagement part movable between an unengaged position where the second engagement part is not engaged with the first engagement part in the state where the image formation device and the developer container are joined to each other in place and an engaged position where the second engagement part is engaged with the first engagement part in the state where the image formation device and the developer container are joined to each other in place; and a regulation member configured to allow the second engagement part to move within the engaged position and to prevent the second engagement part to move from the engaged position to the unengaged position.

A third aspect of the invention is an image formation unit including: a developer container containing developer therein an image formation device configured to form a developer image with the developer; a first engagement part provided at the image formation device; a second engagement part movably provided at the developer container, the second engagement part movable between an unengaged position where the second engagement part is not engaged with the first engagement part in the state where the image formation device and the developer container are joined to each other in place and an engaged position where the second engagement part is engaged with the first engagement part in the state where the image formation device and the developer container are joined to each other in place; and a lock member configured to be attached to the developer container and configured to prevent the developer container from being detached from the image formation device in the state where the second engagement part is located in the unengaged position.

A fourth aspect of the invention is an image formation apparatus includes the image formation unit according to one of the aspects

DETAILED DESCRIPTION OF THE EMBODIMENTS

Figure 1:
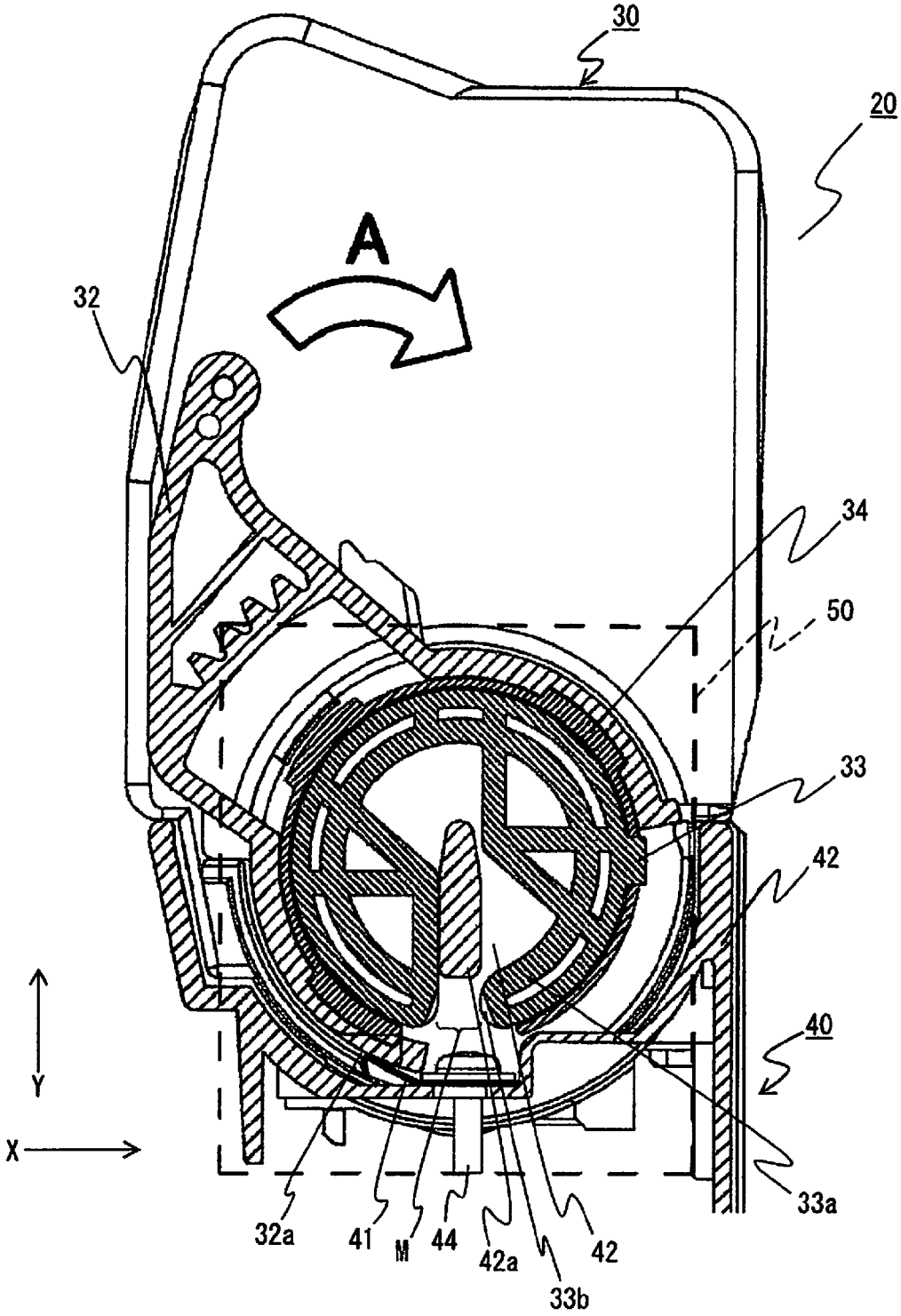
FIG. 1 is a configuration diagram of a part of an image formation unit shown in FIG. 2 according to a first embodiment.

Descriptions are provided below for embodiments based on the drawings. In the respective drawings, the same constituents are designated by the same reference numerals and duplicate explanations concerning the same constituents are omitted. The drawings illustrate the respective examples only.

[First Embodiment]

(Configuration of the First Embodiment)

Figure 2:
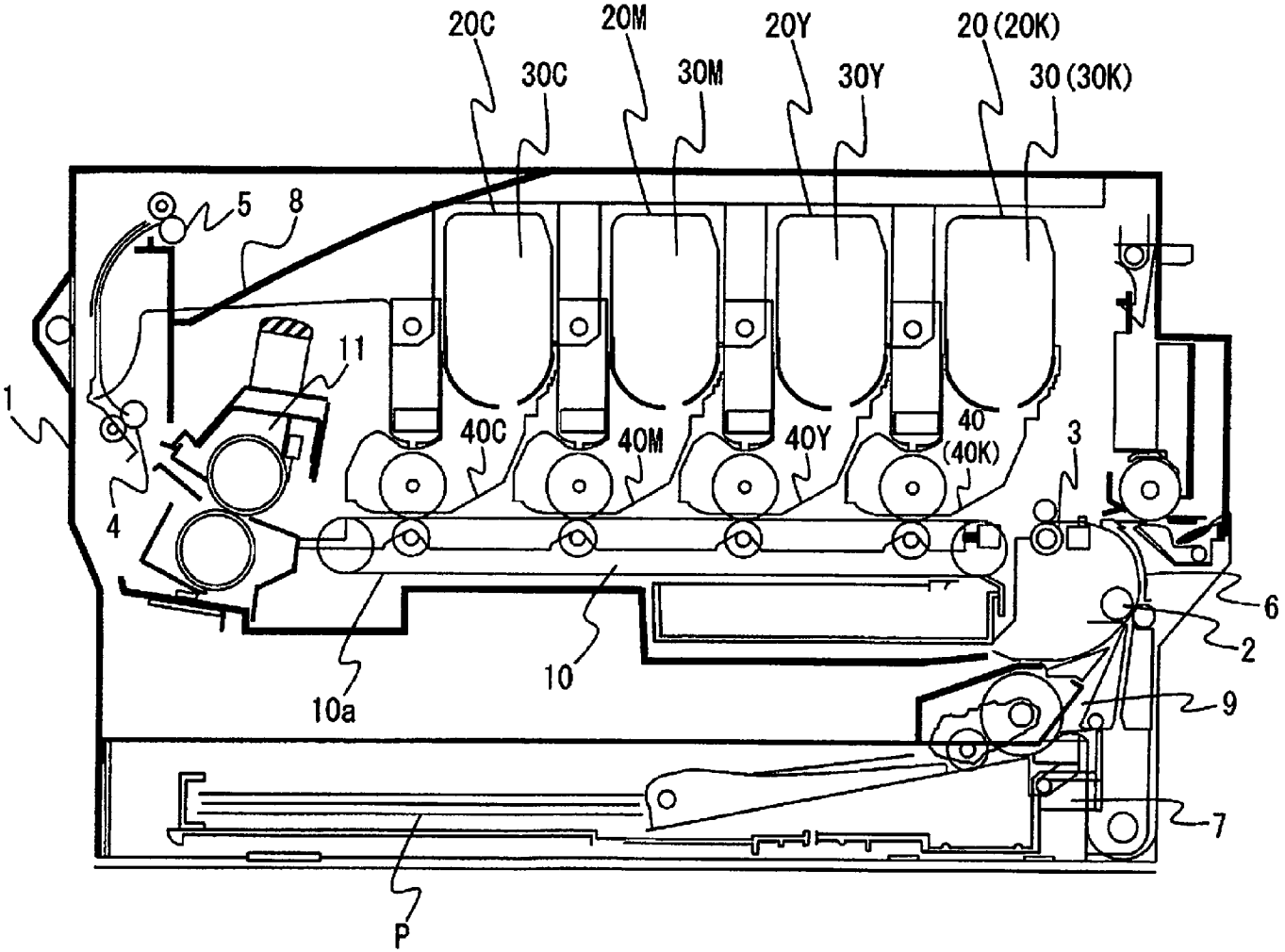
FIG. 2 is a configuration diagram schematically illustrating an image formation apparatus according to the first embodiment.

FIG. 2 is a diagram schematically illustrating an image formation apparatus according to the first embodiment. The image formation apparatus is an electrophotographic color page printer in this embodiment.

Sheet conveyance passage 6 having feed rollers 2 and 3 and discharge rollers 4 and 5 is provided at lower frame 1 of the image formation apparatus. Sheet cassette 7, which can contain recording media (for example, sheets of paper) P therein, is provided at the upstream end of sheet conveyance passage 6. Stacker 8 is provided at the downstream end of sheet conveyance passage 6. Provided along sheet conveyance passage 6 are: sheet feed section 9 configured to feed sheet P from sheet cassette 7; image transfer belt unit 10 configured to convey fed sheet P while attaching sheet P thereon by means of electrostatic effect; and fuser unit 11 or a fixation unit configured to fix developer (for example, toner) T to sheet P.

Four image formation units 20 (20K, 20Y, 20M, and 20C) are arranged above image transfer belt unit 10. Each image formation unit 20 includes: image formation device 40 (40K, 40Y, 40M, 40C) configured to form a toner image (a developer image) using toner T (developer) supplied thereto; and developer container 30 containing toner T therein provided above image formation device 40.

Figure 3:
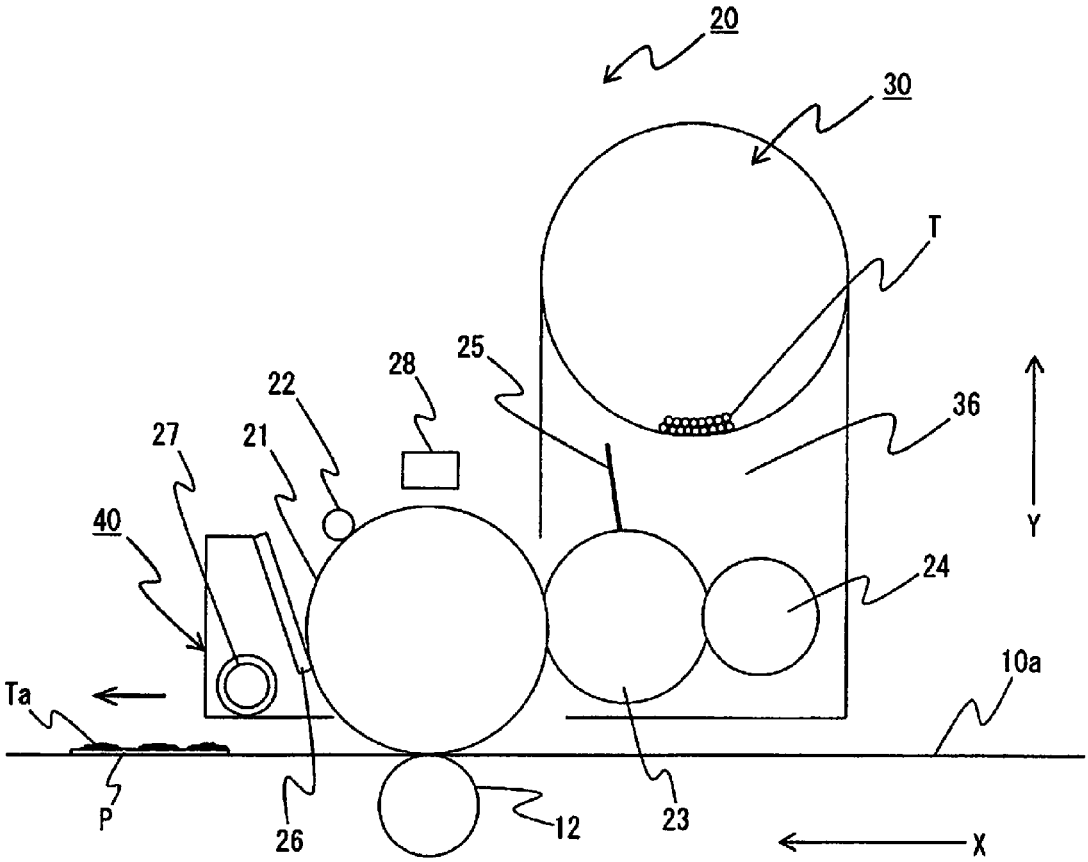
FIG. 3 is a configuration diagram schematically illustrating the image formation unit shown in FIG. 2.

FIG. 3 is a configuration diagram of image formation unit 20 shown in FIG. 2. Four image formation units 20 have the same configuration except for the color of toner T. As described above, image formation unit 20 includes: developer container 30 provided at an upper section thereof; and image formation device 40 provided at a lower section thereof.

Developer container 30 contains therein toner T and is configured to provide toner T to image formation device 40. That is, developer container 30 has supply port 36 or an opening through which toner T is supplied to image formation device 40.

Image formation device 40 provided at the lower section of image formation unit 20 includes photosensitive member 21 (for example, a photosensitive drum) configured to carry thereon an electrostatic latent image and toner image Ta (a developer image) which is formed by developing the electrostatic latent image with toner T supplied thereto. Photosensitive member 21 is rotary driven by an unillustrated motor and is configured to retain electrical charge on the surface thereof to carry the electrostatic latent image.

Image formation device 40 further includes charge roller 22 serving as a charge device. Charge roller 22 is provided in contact with the surface of photosensitive member 21 at a constant pressure and is configured to charge the surface of photosensitive member 21 by applying a predetermined voltage to the surface of photosensitive member 21. Charge roller 22 is driven to rotate in the same direction as photosensitive member 21.

Light emitting diode (hereinafter, referred to as "LED") head 28 serving as an exposure device is provided above photosensitive member 21. LED head 28 is configured to emit light based on a print image data received from an external apparatus (not shown) to change the electric potential of exposed spots in the charged surface of photosensitive member 21, thereby forming an electrostatic latent image on the surface of photosensitive member 21.

Image formation device 40 further includes: development roller 23 configured to supply toner T that is supplied from developer container 30 to photosensitive member 21; sponge roller 24 or a supply roller configured to supply toner T from developer container 30 to development roller 23; and development blade 25 configured to regulate the thickness of toner T on development roller 23 to a constant thickness. Development roller 23 is provided in contact with photosensitive member 21 at a constant pressure.

Beneath image formation device 40, image transfer belt 10*a* and image transfer rollers 12 are provided. Image transfer rollers 12 are provided facing photosensitive members 21 respectively with the upper line of image transfer belt 10*a* between image transfer rollers 12 and photosensitive members 21. Toner image Ta on photosensitive member 21 is transferred to sheet P that is passing between photosensitive member 21 and image transfer roller 12 by means of the Coulomb force between photosensitive member 21 and image transfer roller 12.

Image formation device 40 further includes cleaning blade 26. Cleaning blade 26 has a function to remove residual toner T remaining on photosensitive member 21. Removed toner T is conveyed by conveyance member 27 and a belt (not shown) into developer container 30.

Figure 4:
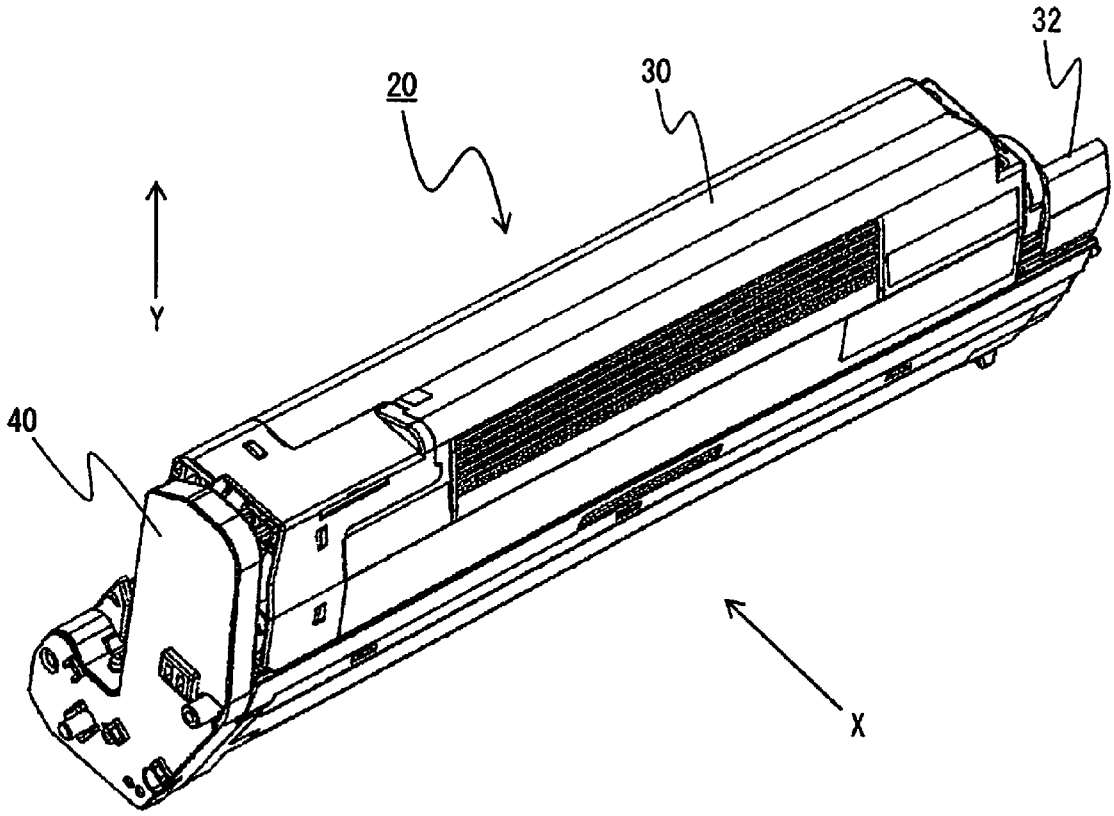
FIG. 4 is a perspective view of the image formation unit shown in FIG. 2, as seen from the upstream side of the sheet conveyance direction.
Figure 5:
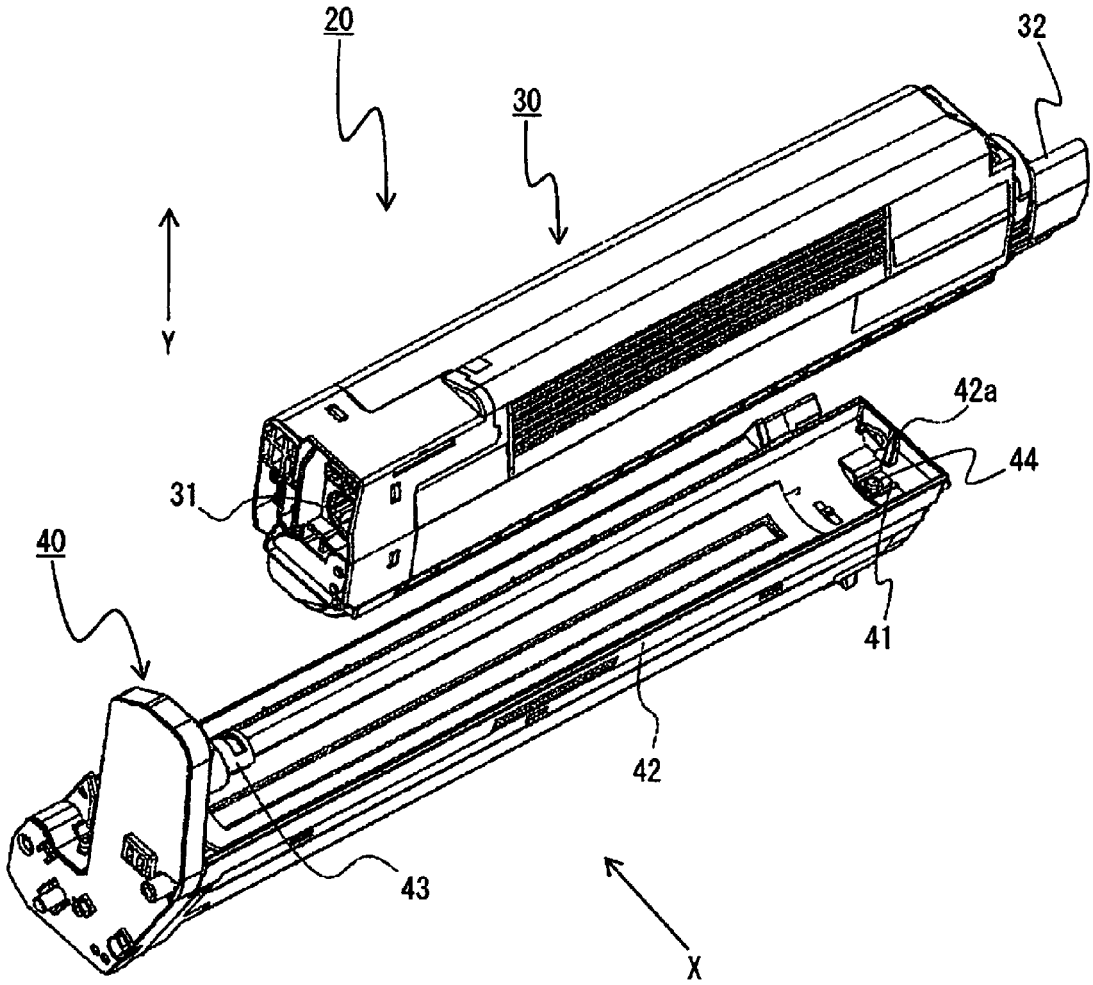
FIG. 5 is an exploded perspective view of the image formation unit shown in FIG. 2.

FIG. 4 is a perspective view of image formation unit 20 shown in FIG. 2, as seen from the upstream side of conveyance direction X of sheet P. FIG. 5 is an exploded perspective view of image formation unit 20 shown in FIG. 2.

As shown in FIG. 4, developer container 30 is joined to image formation device 40 from the upper side (Y) in the vertical direction. Lever 32, serving as an manipulation part, is provided at an longitudinal end of image formation unit 20 (at a right end of image formation unit 20 as seen in sheet conveyance direction X). Lever 32 is configured to rotate shutter 34 serving as a shield member.

As shown in FIG. 5, stopper 41 serving as a regulation member is fixed to image formation device 40 by screw 44. Stopper 41 is made of a stainless steel plate in this embodiment. Image formation device 40 includes upper cover 42 made of synthetic resin. Upper cover 42 is formed with hook 42*a* serving as a first engagement part.

Image formation device 40 has discharge port 43 through which toner T that is removed from photosensitive body 21 by cleaning blade 26 is discharged to the outside of image formation device 40. Removed toner T, which is removed from photosensitive body 21 by cleaning blade 26, is conveyed through a passage (not shown) to discharge port 43 by the belt (not shown) and conveyance member 27. Developer container 30 has recovery port 31 through which toner T is recovered into developer container 30. Toner T that is conveyed to discharge port 43 is recovered through recovery port 31 into developer container 30. Discharge port 43 of image formation device 40 and recovery port 31 of developer container 30 are fit to each other along the longitudinal direction of image formation unit 20, at one longitudinal end of image formation unit 20 (the left end of image formation unit 20 as seen in sheet conveyance direction X). Therefore, at the left end of image formation unit 20, developer container 30 cannot be moved upwardly to be detached from image formation device 40.

Figure 6:
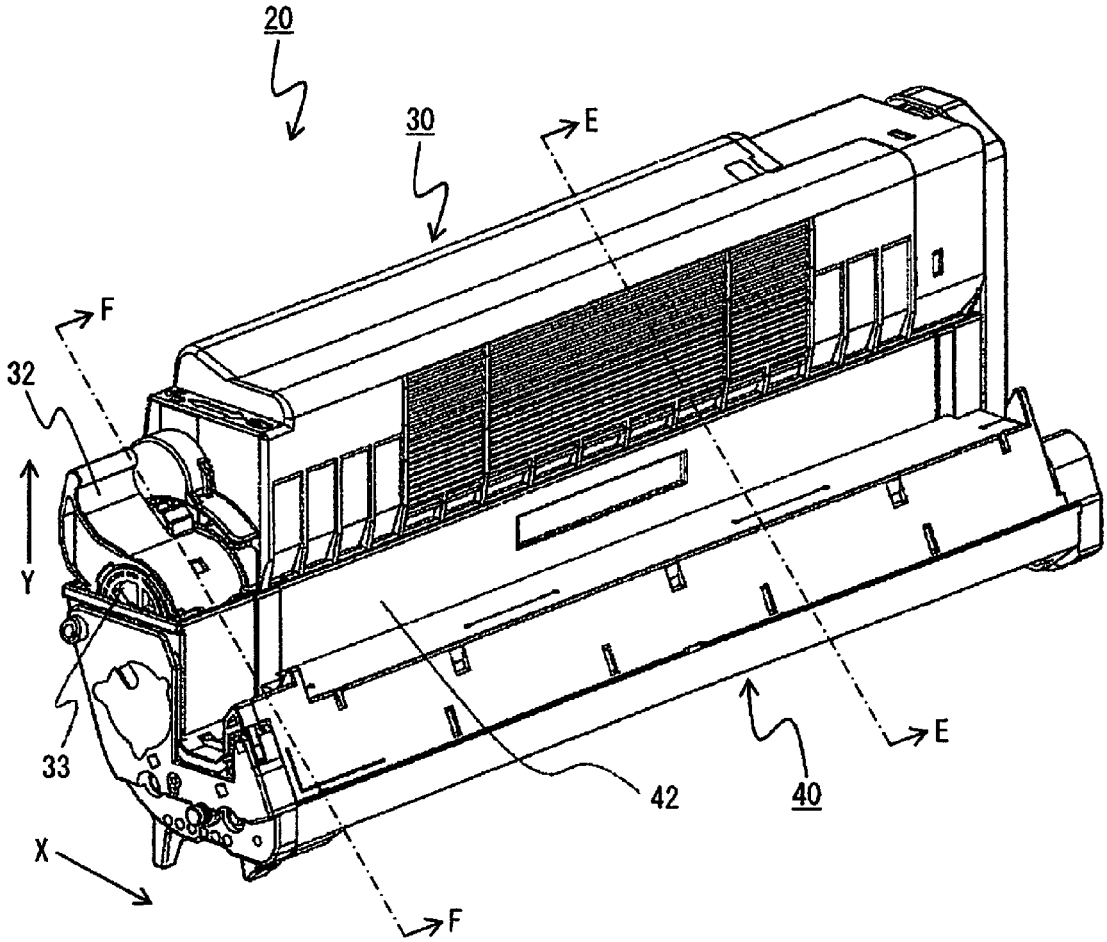
FIG. 6 is a perspective view of the image formation unit shown in FIG. 2, as seen from the downstream side of the sheet conveyance direction.

FIG. 6 is a perspective view of image formation unit 20 shown in FIG. 2, as seen from the downstream side of conveyance direction X of sheet P.

FIG. 6 illustrates the state where developer container 30 and image formation device 40 are joined to each other. As referring to FIG. 6, lever 32 and cap 33 are provided at an longitudinal end of developer container 30 (the right end of developer container 30 as seen along sheet conveyance direction X, that is, a left end of the right end of developer container 30 as seen in FIG. 6). Lever 32, serving as an manipulation part, is configured to rotate shutter 34 serving as the shield member or etc. Cap 33, serving as a lid, is configured to close an opening through which toner T is introduced into developer container 30.

FIG. 1 is a configuration diagram illustrating a part of image formation unit 20 shown in FIG. 2 according to the first embodiment.

FIG. 1 illustrates a cross section, along Line F-F in FIG. 6, of the right end portion of image formation unit 20 as seen in sheet conveyance direction X.

As shown in FIG. 1, lever 32, cap 33, and shutter 34 are provided at the right end portion of developer container 30. Cap 33 and shutter 34 are rotatable about rotational axis 37 (see FIG. 8) and are rotated by the rotation of lever 32. Cap 33 is formed with a catch portion or latch portion 33*a*, serving as a second engagement part. Latch portion 33*a* is configured to engage with hook 42*a*, serving as a first engagement part. Cap 33, shutter 34, and lever 32 are fixed to each other to integrally rotate.

Upper cover 42 of image formation device 40 is provided with hook 42*a* at the right end portion of image formation device 40 as seen in sheet conveyance direction X. Stopper 41 is detachably screwed, by screw 44 serving as a fixing member, to upper cover 42 of image formation device 40 beneath Hook 42*a*.

As shown in FIG. 1, stopper 41 is elastically bent by being pushed against contact face 32*a* of lever 32, before lever 32 is rotated in direction A. That is, when developer container 30 and image formation device 40 are joined to each other with shutter 34 closed. Stopper 41 is formed of a plate spring and having arc curve portion 41*b* (see FIG. 8B) at the tip portion which is to be in contact with contact surface 32*a*.

Lever 32, cap 33, stopper 41, upper cover 42, and hook 42*a* make up coupling section 50, which functions to couple image formation device 40 and developer container 30 to each other.

Figure 7:
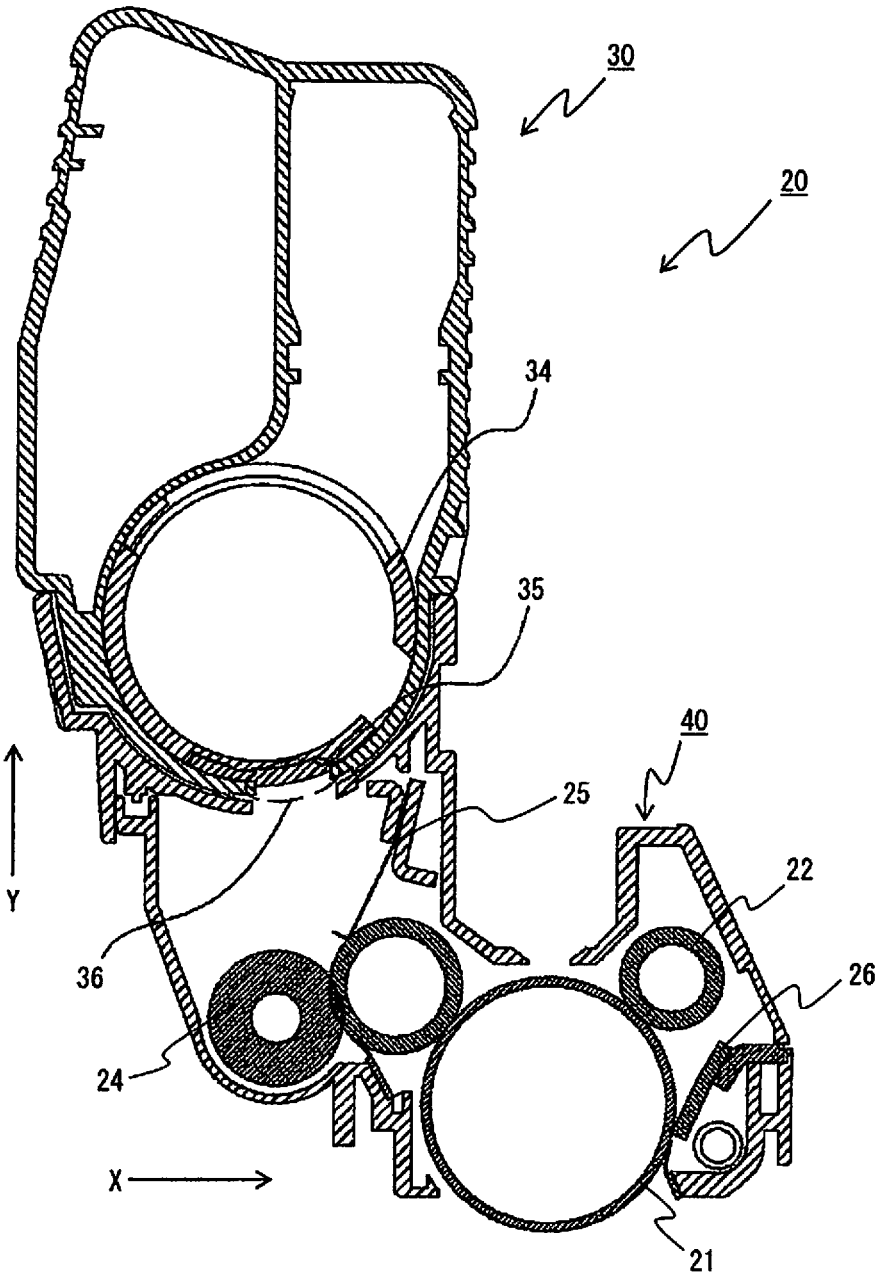
FIG. 7 is a sectional view of the image formation unit along line E-E in FIG. 6.

FIG. 7 is a sectional view of image formation unit 20 along Line E-E in FIG. 6. As shown in FIG. 7, the lower end or the bottom wall of developer container 30 is formed with supply port 36 extending along the longitudinal direction of developer container 30 to supply toner T to image formation device 40. Developer container 30 includes shutter 34 extending along the longitudinal direction of developer container 30 like supply port 36, which is configured to open and close supply port 36. Shutter 34 has a circular cylindrical shape and configured to open and close supply port 36 corresponding to its rotational position.

Shutter 34 is provided with seal sponge 35 serving as a seal member to prevent leakage of toner T. When shutter 34 is in a close position, seal sponge 35 shuts supply port 36 so as to prevent toner T from leaking to the outside. When shutter 34 is in an open position, shutter 34 opens supply port 36 to supply toner T from developer container 30 through supply port 36 into image formation device 40.

Figure 8A:
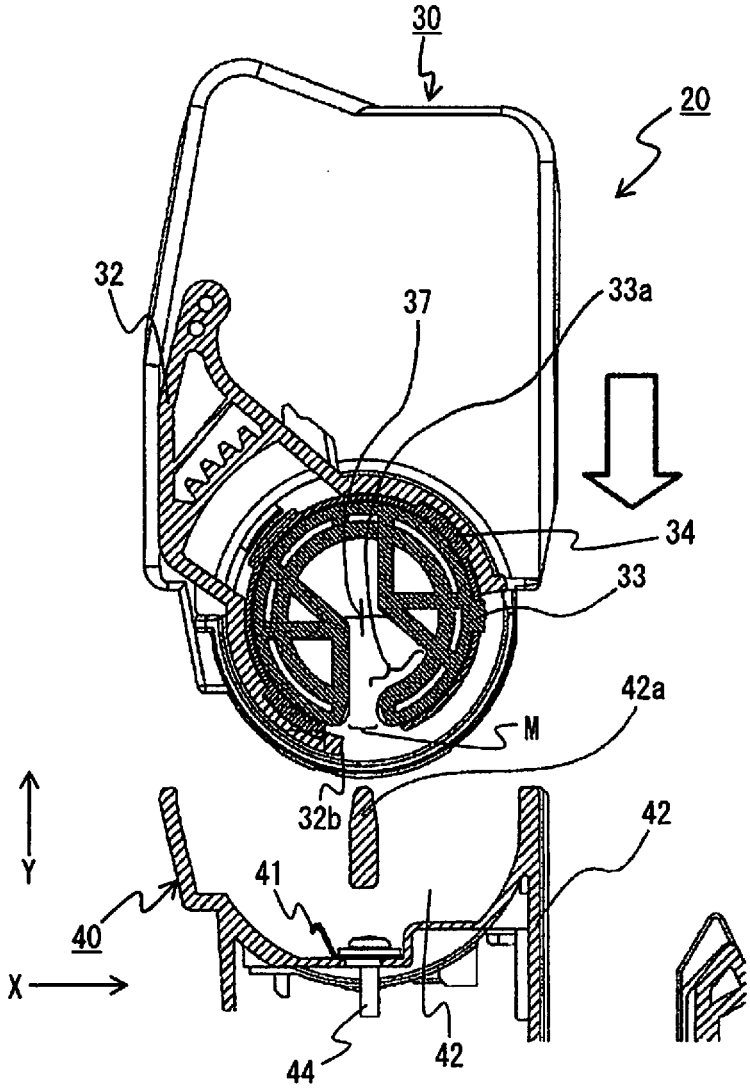
FIG. 8A is a sectional view, along line F-F in FIG. 6, illustrating the image formation unit in the state before a developer container is joined to an image formation device.
Figure 8B:
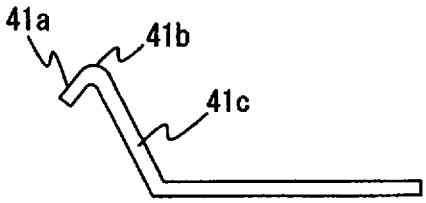
FIG. 8B is an enlarged view of a stopper shown in FIG. 8A.

FIGS. 8A and 8B are sectional views illustrating image formation unit 20 in the state before developer container 30 is joined to image formation device 40. FIG. 8A is a cross section along line F-F in FIG. 6, illustrating the state before developer container 30 is joined to image formation device 40. FIG. 8B is an enlarged view of stopper 41 shown in FIG. 8A.

There is rotational axis 37 (which is not shown in FIG. 1) at the center of cap 33. Cap 33 is rotatable about rotational axis 37 and is rotated by the rotational operation of lever 32. The other configurations have been described above with reference to FIG. 1. Stopper 41 is formed of a plate spring and includes arc curve portion 41*b*, propping portion 41*a*, and elastic body 41*c*.

(Operation of the First Embodiment)

The overall operation of the image formation apparatus is described below with reference to FIG. 2.

Sheet P is fed by sheet feed section 9 from sheet cassette 7 to sheet conveyance passage 6 and is conveyed by feed rollers 2 and 3 to image transfer belt unit 10 along sheet conveyance passage 6. While sheet P is conveyed on image transfer belt unit 10, toner image Ta formed by each image formation unit 20 is transferred onto sheet P. Then, sheet P is conveyed to fuser unit 11 and toner T (interposed toner images) is fixed to sheet P by fuser unit 11. After that, sheet P is discharged by discharge rollers 4 and 5 to stacker 8.

Next, operation of image formation unit 20 is described below with reference to FIG. 3. As charge roller 22 applies a constant voltage to the surface of photosensitive member 21, the surface of photosensitive member 21 is uniformly charged. Next, as LED head 28 irradiates light according to image data onto the uniformly charged surface of photosensitive member 21 to eliminate the charge at the irradiated area, an electrostatic latent image is formed on the surface of photosensitive member 21.

Toner T in developer container 30 is supplied through supply port 36 into image formation device 40, which is provided above image formation device 40.

In image formation device 40, toner T is supplied to development roller 23 by sponge roller 24 that rotates. Toner T on development roller 23 is metered by development blade 25 to a constant thickness, as development roller 23 rotates. As development roller 23 rotates in contact with photosensitive member 21, toner T on development roller 23 is supplied onto the surface of photosensitive member 21.

This develops the electrostatic latent image on the surface of photosensitive member 21 with toner T, thereby forming toner image Ta. Toner image Ta is transferred by image transfer rollers 12 onto sheet P that is conveyed on image transfer belt 10*a*, thereby forming toner image Ta on sheet P.

Figure 9:
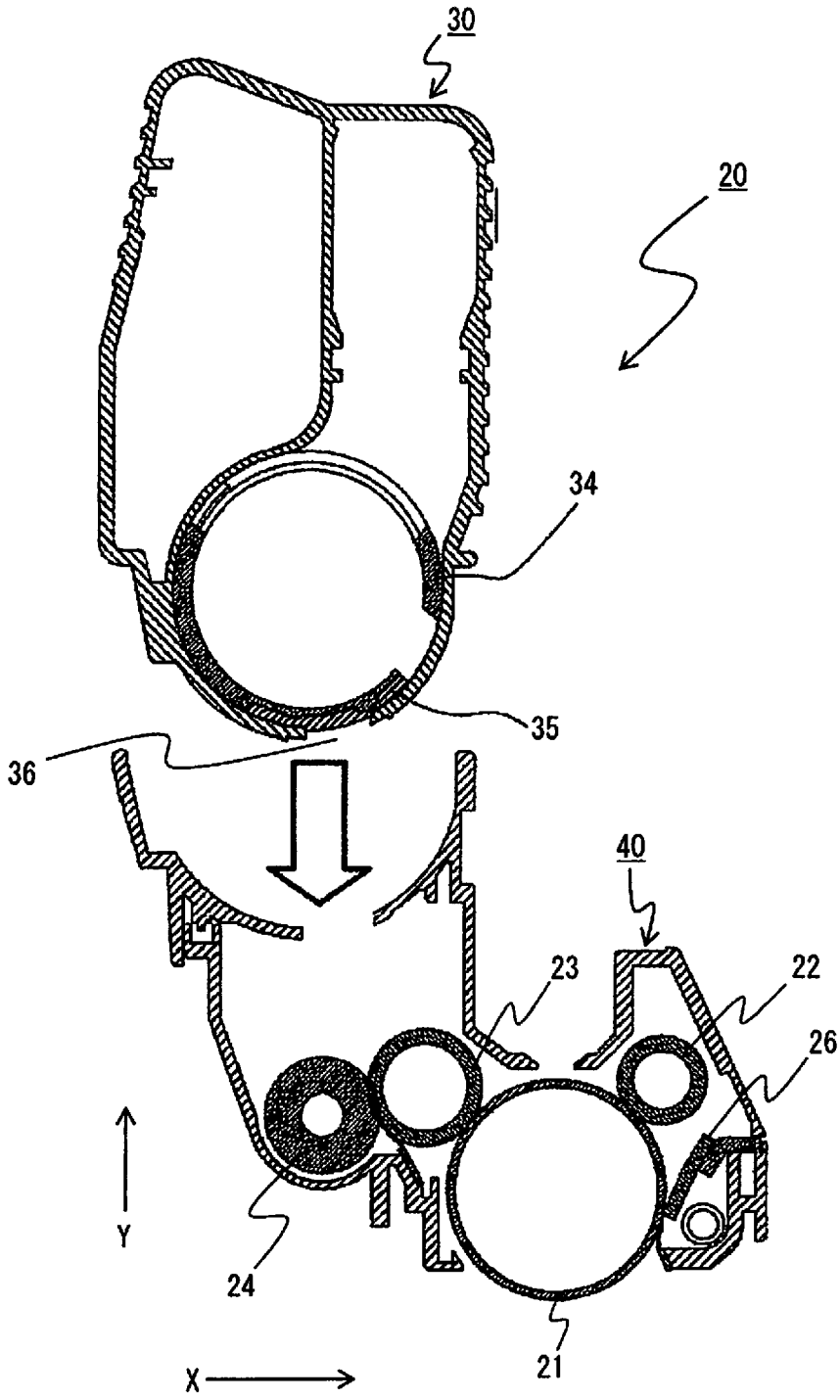
FIG. 9 a sectional view, along line E-E in FIG. 6, illustrating the image formation unit in the state before the developer container is joined to the image formation device.
Figure 10:
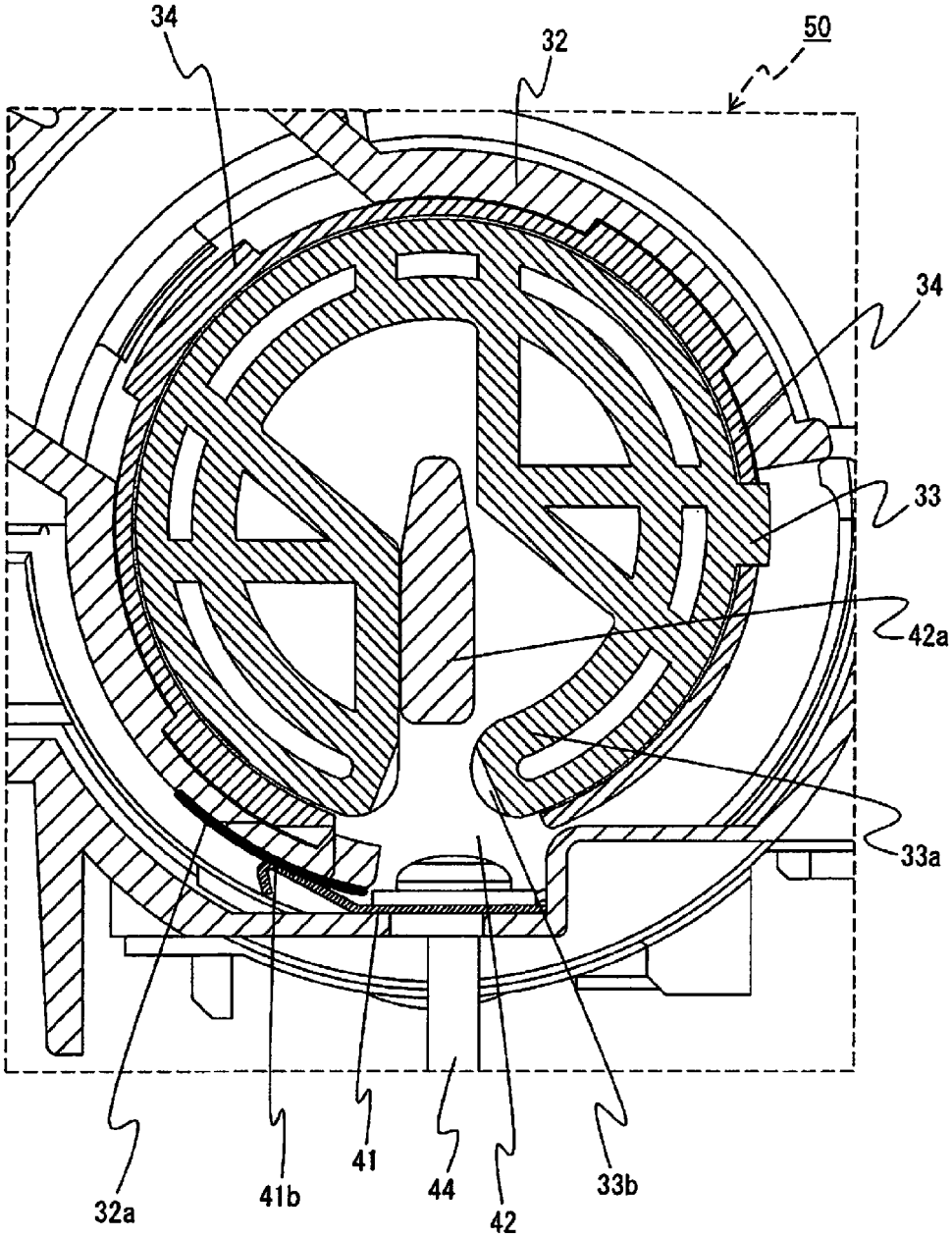
FIG. 10 is an enlarged sectional view of a coupling section shown in FIG. 1.
Figure 11:
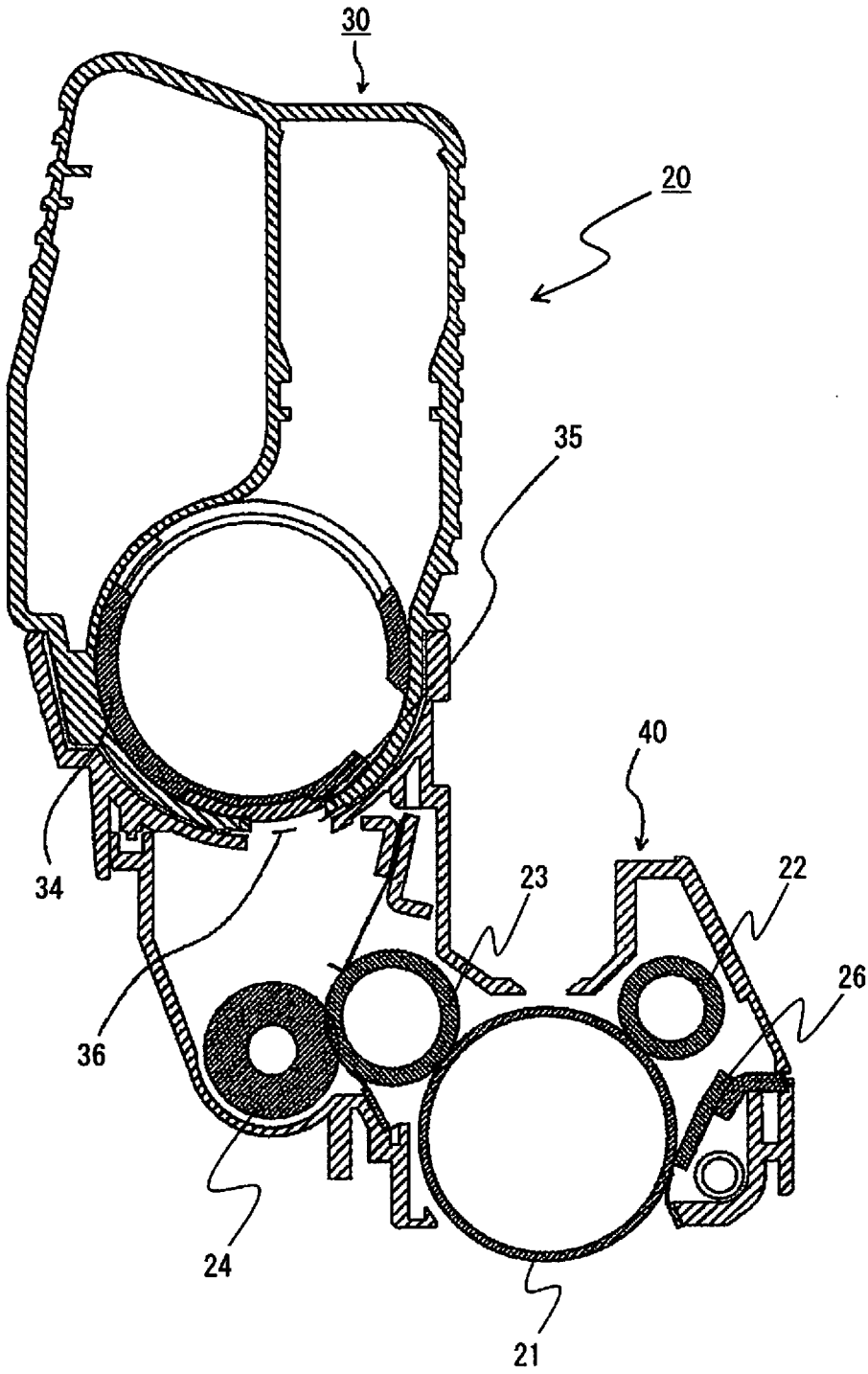
FIG. 11 is a sectional view, along line E-E in FIG. 6, illustrating the image formation unit in the state just after the developer container and the image formation device are joined to each other (that is, in the state where the developer container and the image formation device are joined to each other but not fixed with each other).
Figure 12:
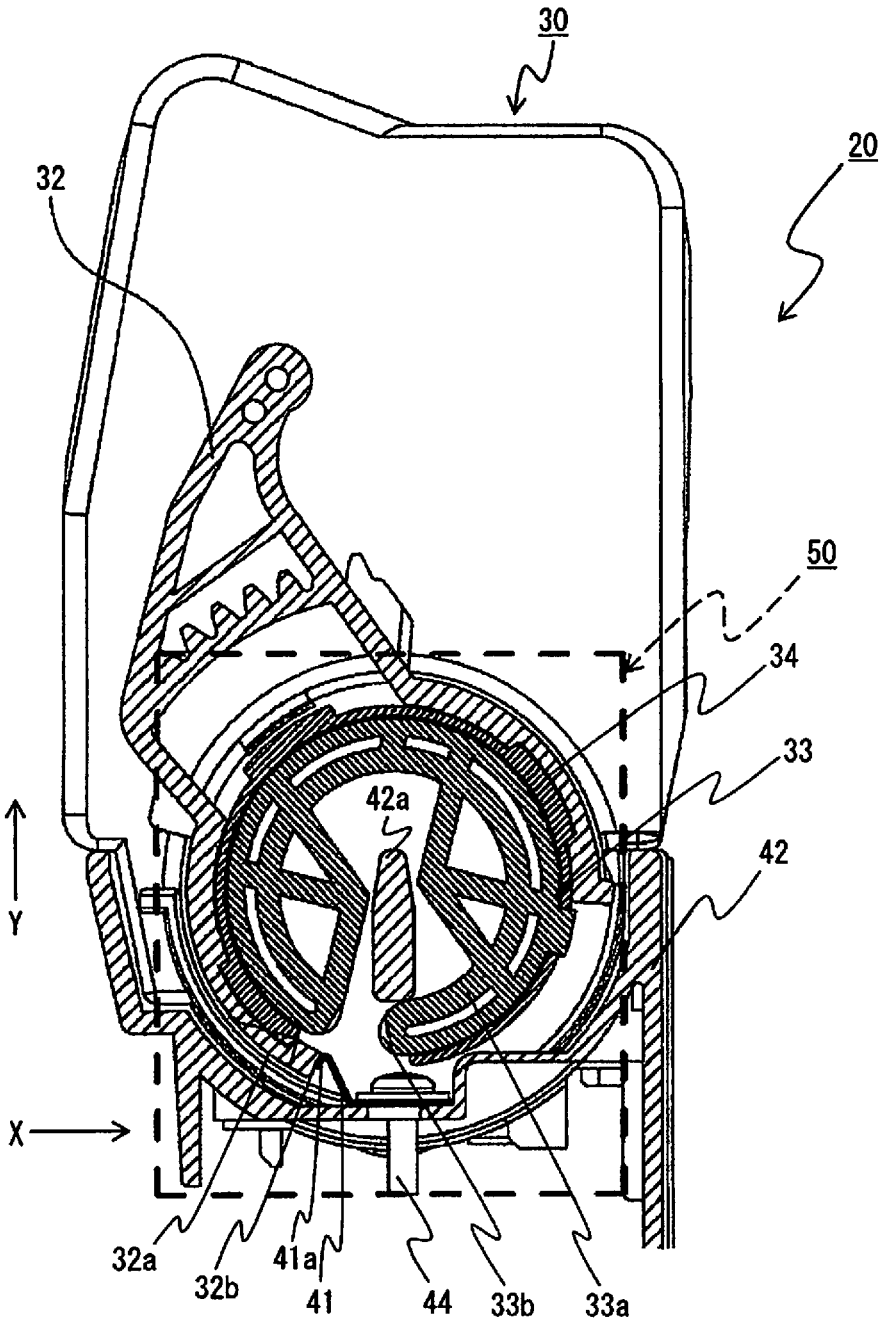
FIG. 12 is a sectional view, along line F-F in FIG. 6, illustrating the image formation unit in the state where the developer container is fixed to the image formation device and a supply port is closed.
Figure 13:
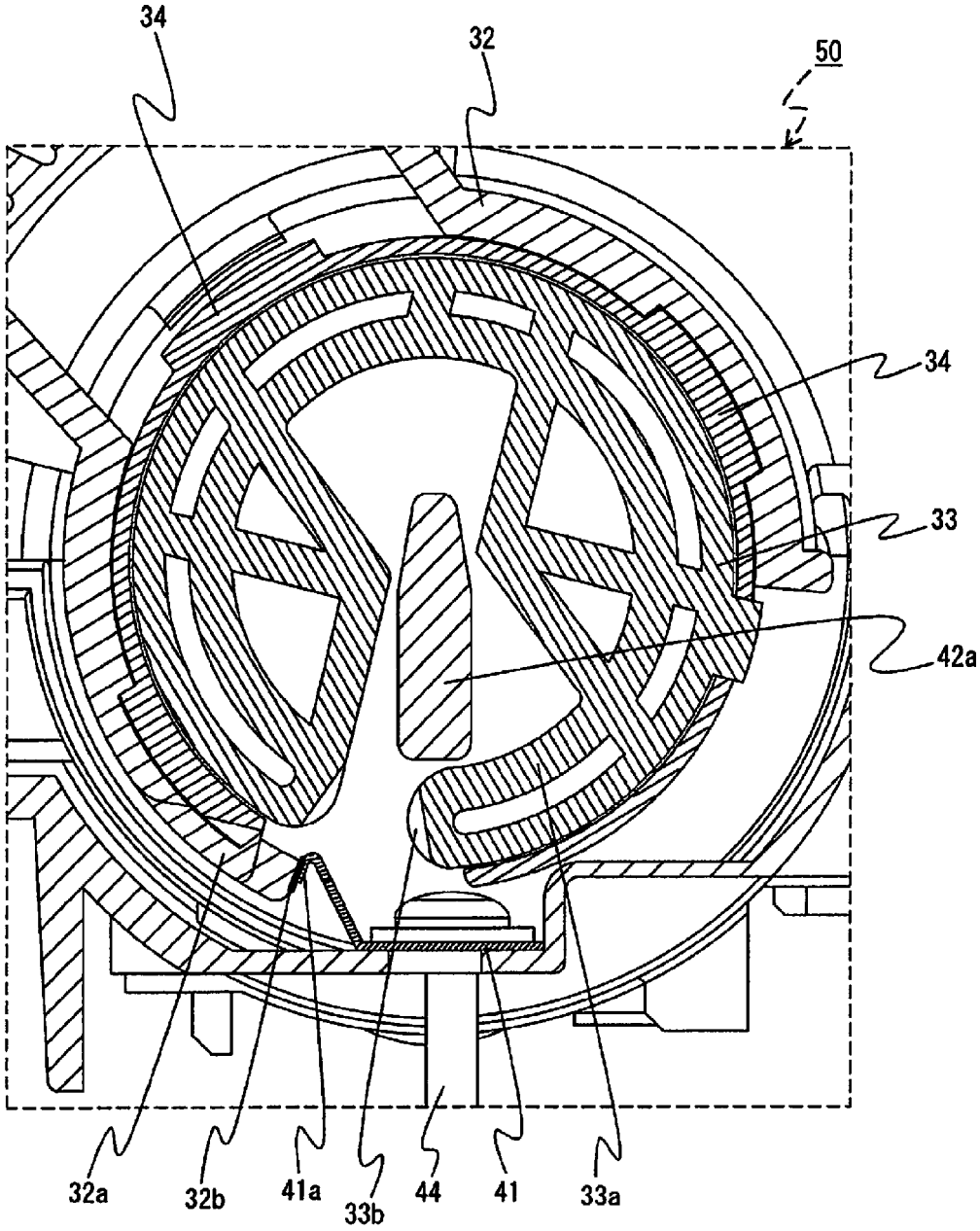
FIG. 13 is an enlarged sectional view of the coupling section of FIG. 12.
Figure 14:
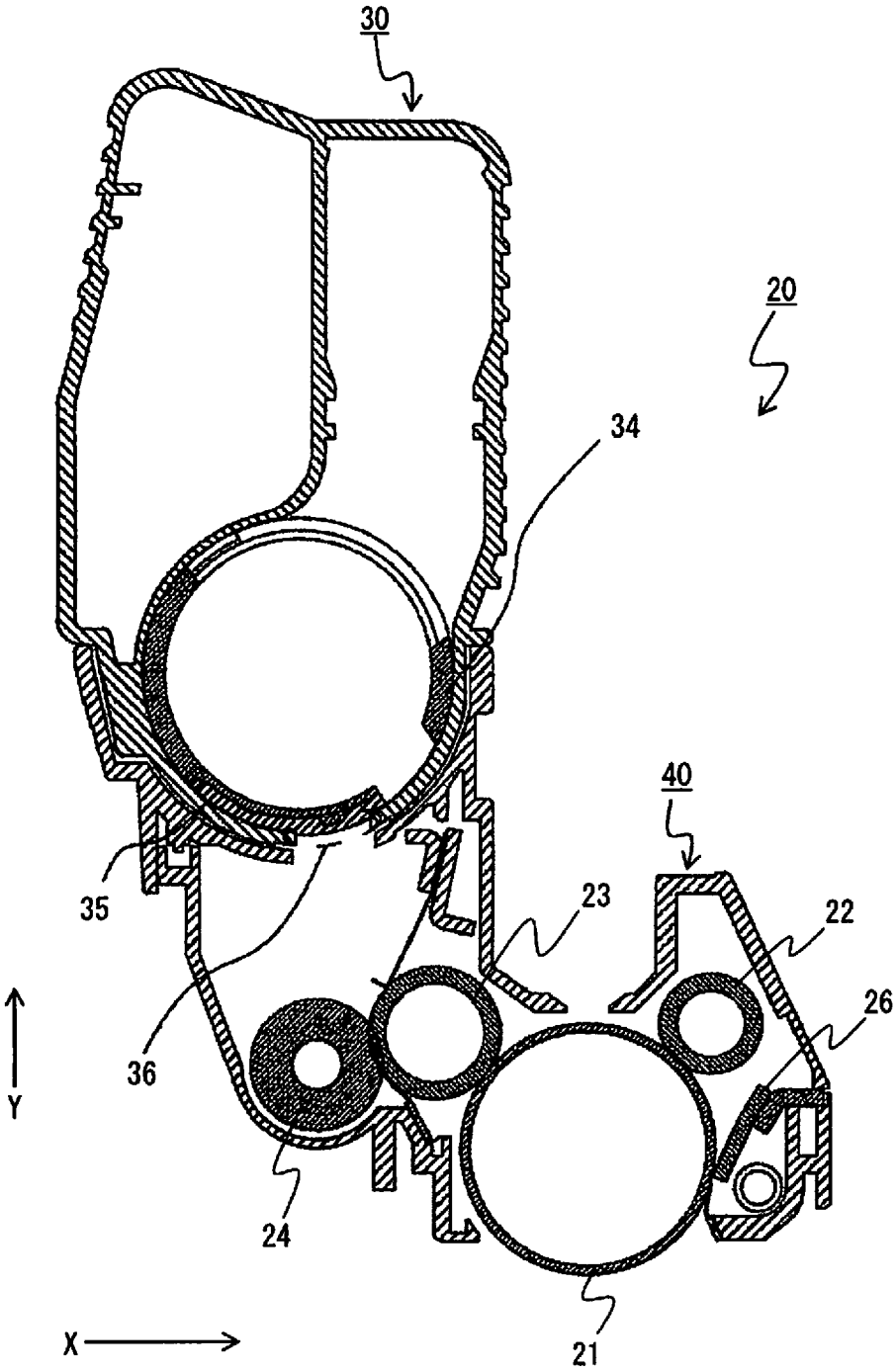
FIG. 14 is a sectional view, along line E-E in FIG. 6, illustrating the image formation unit in the state where the developer container is fixed to the image formation device and the supply port is closed.
Figure 15:
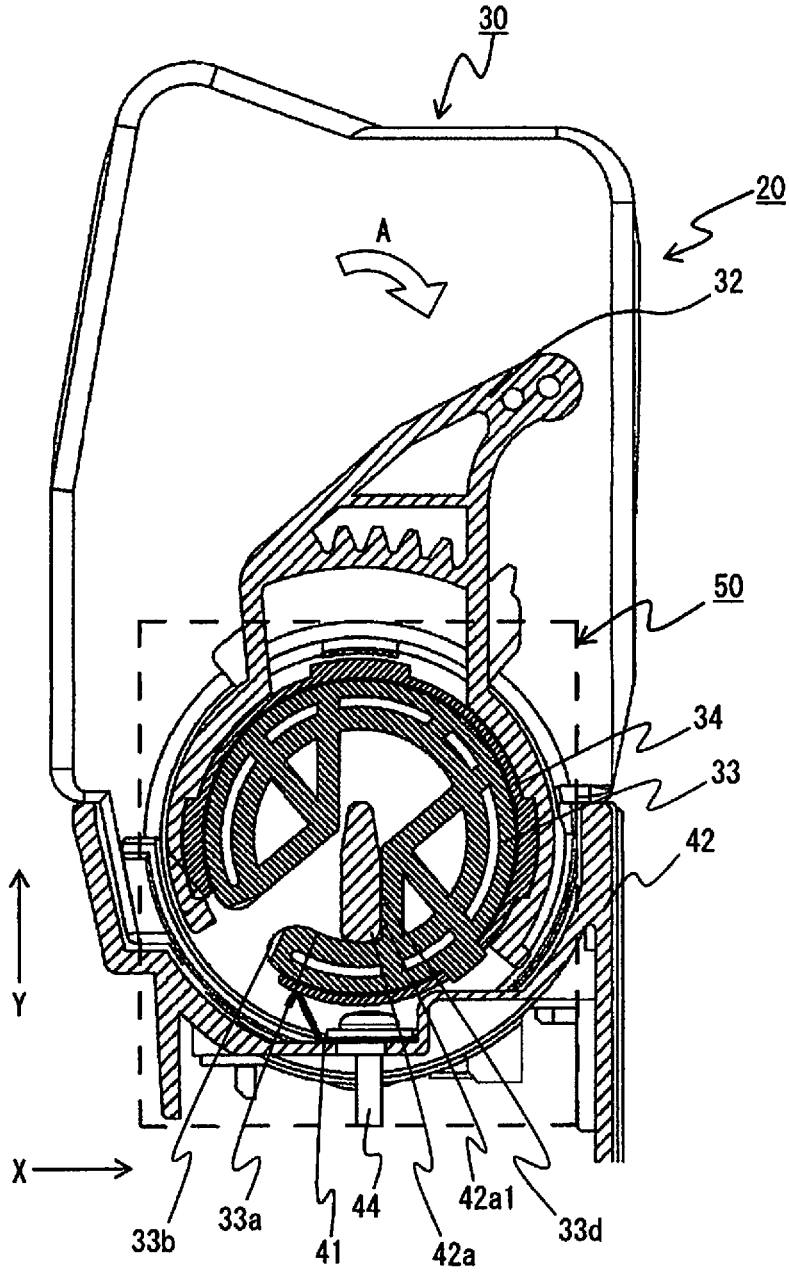
FIG. 15 is a sectional view, along line F-F in FIG. 6, illustrating the image formation unit in the state where the developer container is fixed to the image formation device and the supply port is opened.
Figure 16:
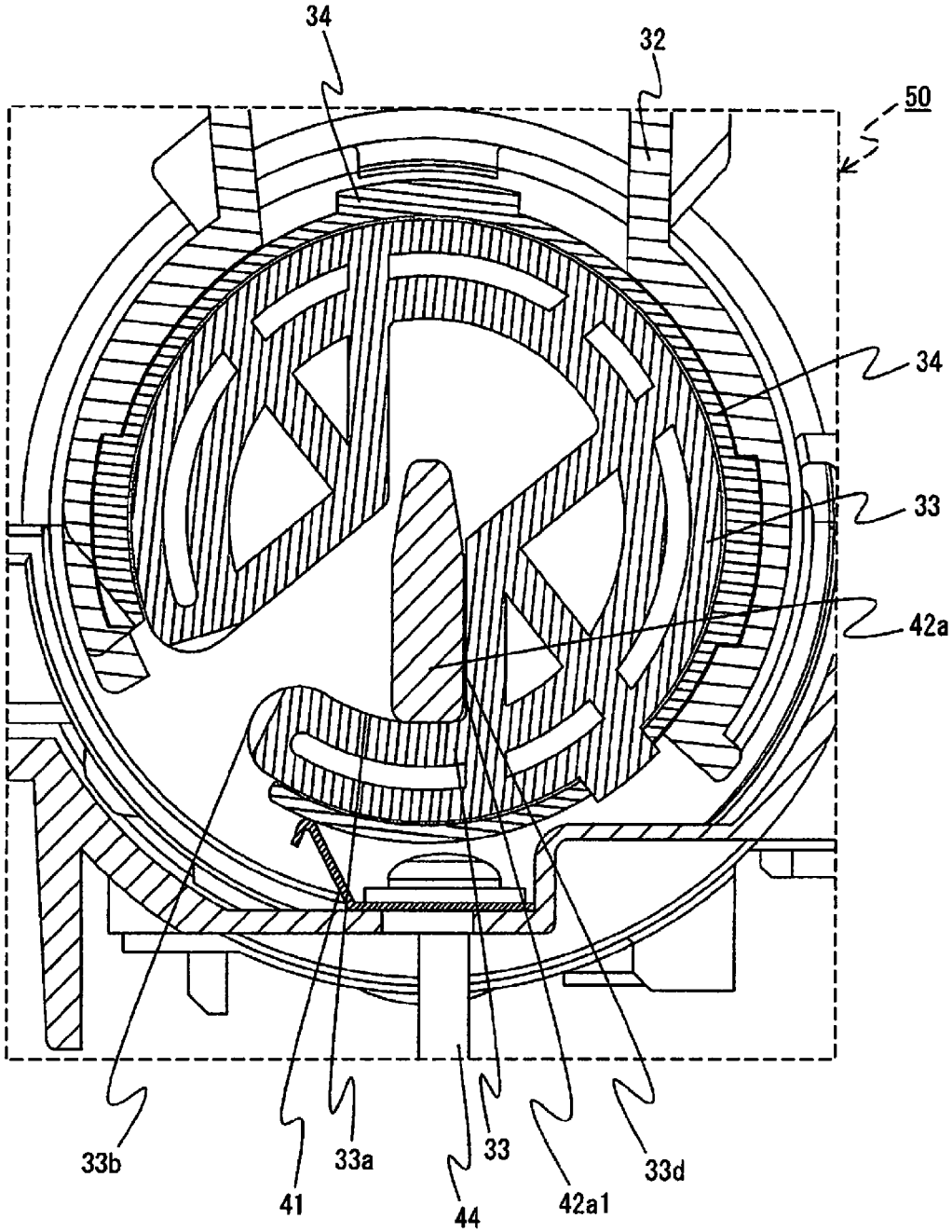
FIG. 16 is an enlarged sectional view of the coupling section of FIG. 15.
Figure 17:
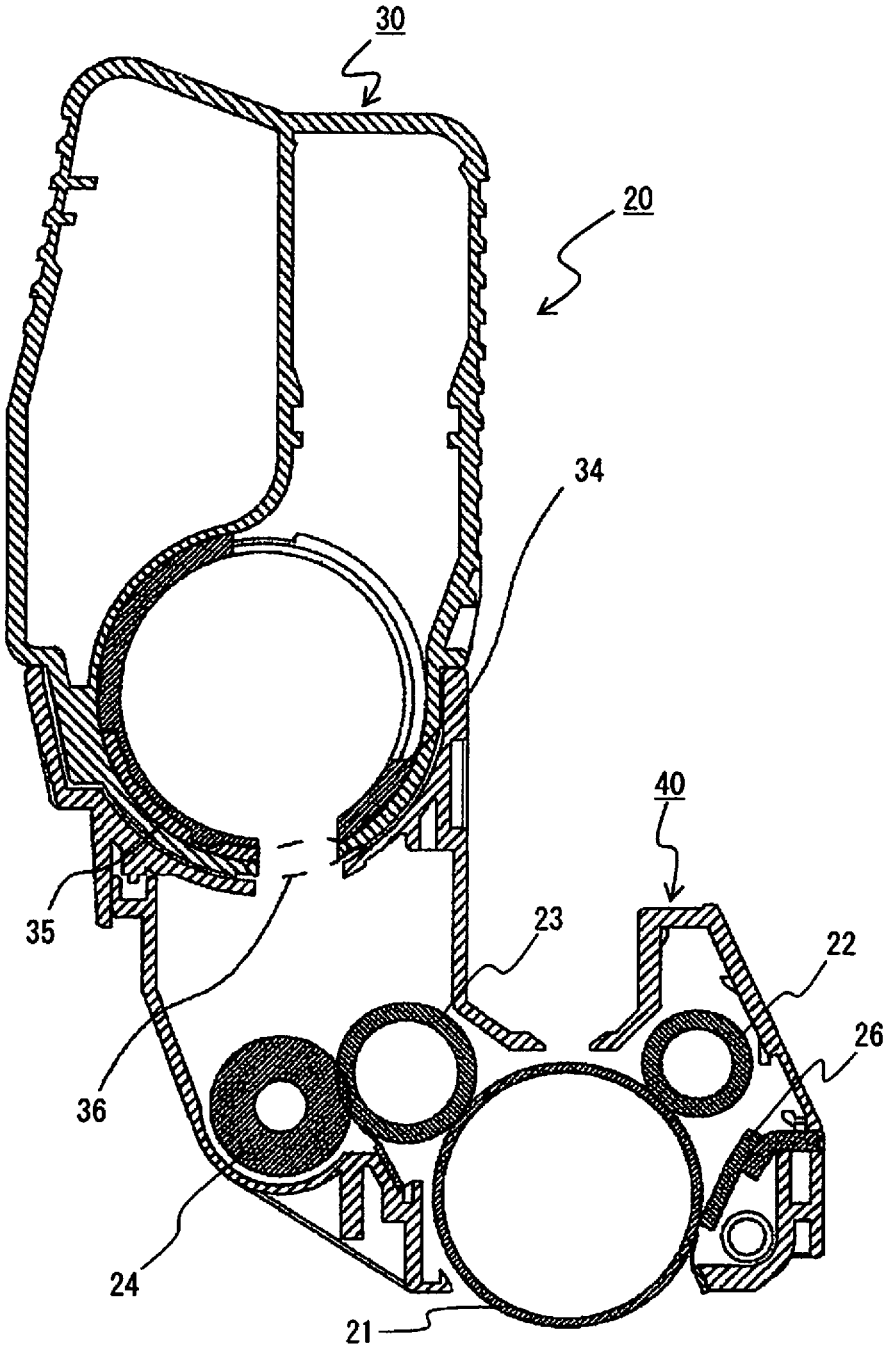
FIG. 17 is a sectional view, along line E-E in FIG. 6, illustrating the image formation unit in the state where the developer container is fixed to the image formation device and the supply port is opened.

Next, a method of coupling developer container 30 and image formation device 40 is described. FIG. 9 a sectional view, along Line E-E in FIG. 6, illustrating image formation unit 20 in the state before developer container 30 and image formation device 40 are joined to each other. FIG. 10 is an enlarged sectional view of coupling section 50 shown in FIG. 1. FIG. 11 is a sectional view, along Line E-E in FIG. 6, illustrating image formation unit 20 in the state just after developer container 30 and image formation device 40 are joined to each other (that is, in the state where the developer container and the image formation device are joined to each other but not fixed with each other). FIG. 12 is a sectional view, along Line F-F in FIG. 6, illustrating image formation unit 20 in the state just after developer container 30 and image formation device 40 are joined to each other. FIG. 13 is an enlarged sectional view of coupling section 50 shown in FIG. 12. FIG. 14 is a sectional view, along Line E-E in FIG. 6, illustrating image formation unit 20 in the state where supply port 36 is closed. FIG. 15 is a sectional view, along Line F-F in FIG. 6, illustrating image formation unit 20 in the state where supply port 36 is closed. FIG. 16 is an enlarged sectional view of coupling section 50 shown in FIG. 15. FIG. 17 is a sectional view, along Line E-E in FIG. 6, illustrating image formation unit 20 in the state where supply port 36 is opened.

As described above, FIG. 8A illustrates the state before developer container 30 is joined to image formation device 40. First, developer container 30 is moved downwardly to be joined to image formation device 40 in place as shown in FIG. 8A, such that hook 42*a* of image formation device 40 passes through gap M between latch portion 33*a* (the second engagement part) and face 33*c* of cap 33. FIG. 9 also illustrates the state before developer container 30 is joined to image formation device 40, showing the rotational position in image formation unit 20 and shutter 34 shutting opening 36 of developer container 30.

The configuration around supply port 36 in image formation unit 20 in the state where developer container 30 is joined to image formation device 40 is illustrated in FIG. 11. As shown in FIG. 11, supply port 36 of developer container 30 is shut by seal sponge 35 of shutter 34 so that toner T is not supplied from developer container 30 to image formation device 40. FIG. 1 illustrates the configuration around coupling section 50 in the state where developer container 30 is joined to image formation device 40. As shown in FIG. 10, which illustrates the enlarged view of coupling section 50 shown in FIG. 1, stopper 41 is elastically bent by being pressed against contact face 32*a* of lever 32. In the course of coupling developer container 30 to developer container 30, arc curve portion 41*b* of stopper 41 is in slide-contact with contact face 32*b* formed on the outer circumferential surface of lever 32. Therefore, stopper 41 is smoothly pressed down by contact face 32*b* without stopper 41 getting stuck.

Next, lever 32 fixed to shutter 34 is rotated in the direction of arrow A in the direction of arrow A (from the state shown in FIG. 1 (FIG. 10) to the state shown in FIG. 12 (FIG. 13)). In this operation, cap 33 is rotated with the rotation of lever 32, until hook 42*a* is engaged with latch portion 33*a*. When hook 42*a* is engaged with latch portion 33*a*, stopper 41 is released from contact face 32*a* of lever 32 so that stopper 41 returns to the original shape with the resilience as shown in FIGS. 12 and 13. In this state, if lever 32 is tried to be rotated in a direction opposite to arrow direction A, propping portion 41*a* of stopper 41 will come in contact with contact face 32*b* of lever 32 thereby preventing lever 32 from being rotated in the direction opposite to arrow direction A.

In this state, since hook 42*a* and latch portion 33*a* of cap 33 are engaged with each other, developer container 30 cannot be moved in vertically-upward direction Y to be detached from image formation device 40. That is, at one longitudinal end (the left end in FIG. 5) of image formation unit 20, latch portion 33*a* and hook 42*a* are engaged with each other so that developer container 30 cannot be detached from image formation device 40 while moving in vertically-upward direction Y. Note that, at the other longitudinal end (the right end in FIG. 5), as described above with reference to FIG. 5, discharge port 43 of image formation device 40 and recovery port 31 of developer container 30 are fit to each other so that developer container 30 cannot be moved in vertically-upward direction Y to be detached from image formation device 40. Therefore, the coupling between developer container 30 and image formation device 40 is maintained.

In this state, as shown in FIG. 14, supply port 36 of developer container 30 is still closed by seal sponge 35 provided at shutter 34, so that toner T is not supplied from developer container 30 to image formation device 40.

In short, in the state where latch portion 33*a* is located at the position shown in FIGS. 12 to 14, developer container 30 and image formation device 40 cannot be detached from each other while supply port 36 being closed. Therefore, the manufacturer can ship image formation unit 20, as a replacement part, including developer container 30 and image formation device 40 that cannot be detached from each other with supply port 36 being closed. Therefore, the amount of toner T leaking from image formation device 40 is reduced during the delivery from the manufacturer to a user or a dealer.

Next, when the user wants to make image formation unit 20 operable to print, the user further rotates lever 32 of developer container 30 in arrow direction A in FIG. 15 until face 33*d* of cap 33 comes in contact with face 42*a*1 of hook 42*a* as shown in FIG. 15. Thereby, lever 32 is prevented from further rotation in arrow direction A. In this state, as shown in FIGS. 15 and 16, cap 33 and hook 42*a* are engaged with each other, so that developer container 30 cannot be moved in vertically-upward direction Y to be detached from image formation device 40.

In the state where lever 32 is at the position shown in FIG. 15 and FIG. 16, shutter 34 is at the open position to open supply port 36 as shown in FIG. 17. Therefore, in image formation unit 20, toner T is supplied from developer container 30 to image formation device 40, and thus the user can start printing.

Figure 18:
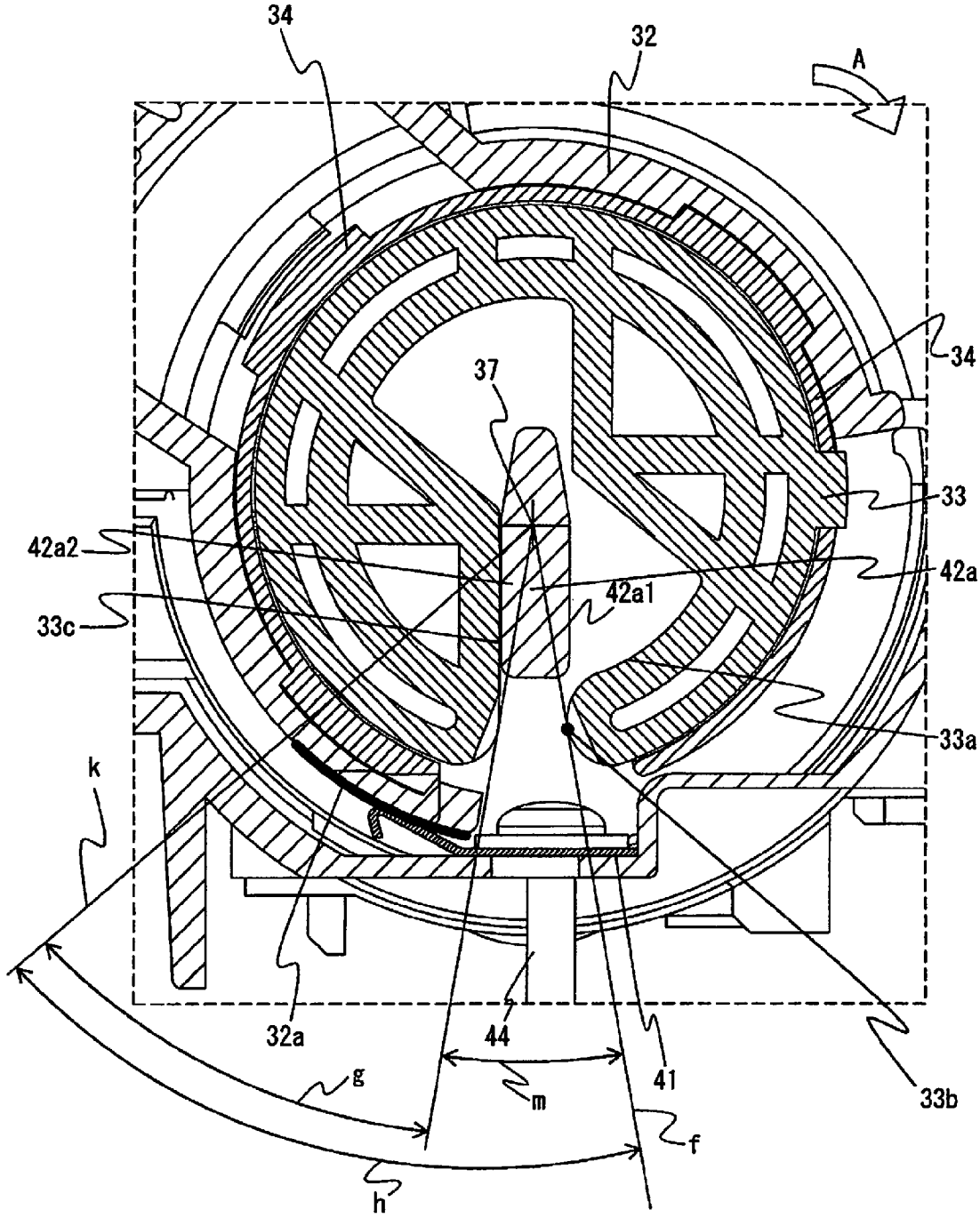
FIG. 18 is an enlarged sectional view of the coupling section, for explaining the detail operation of fixing the developer container to the image formation device.
Figure 19:
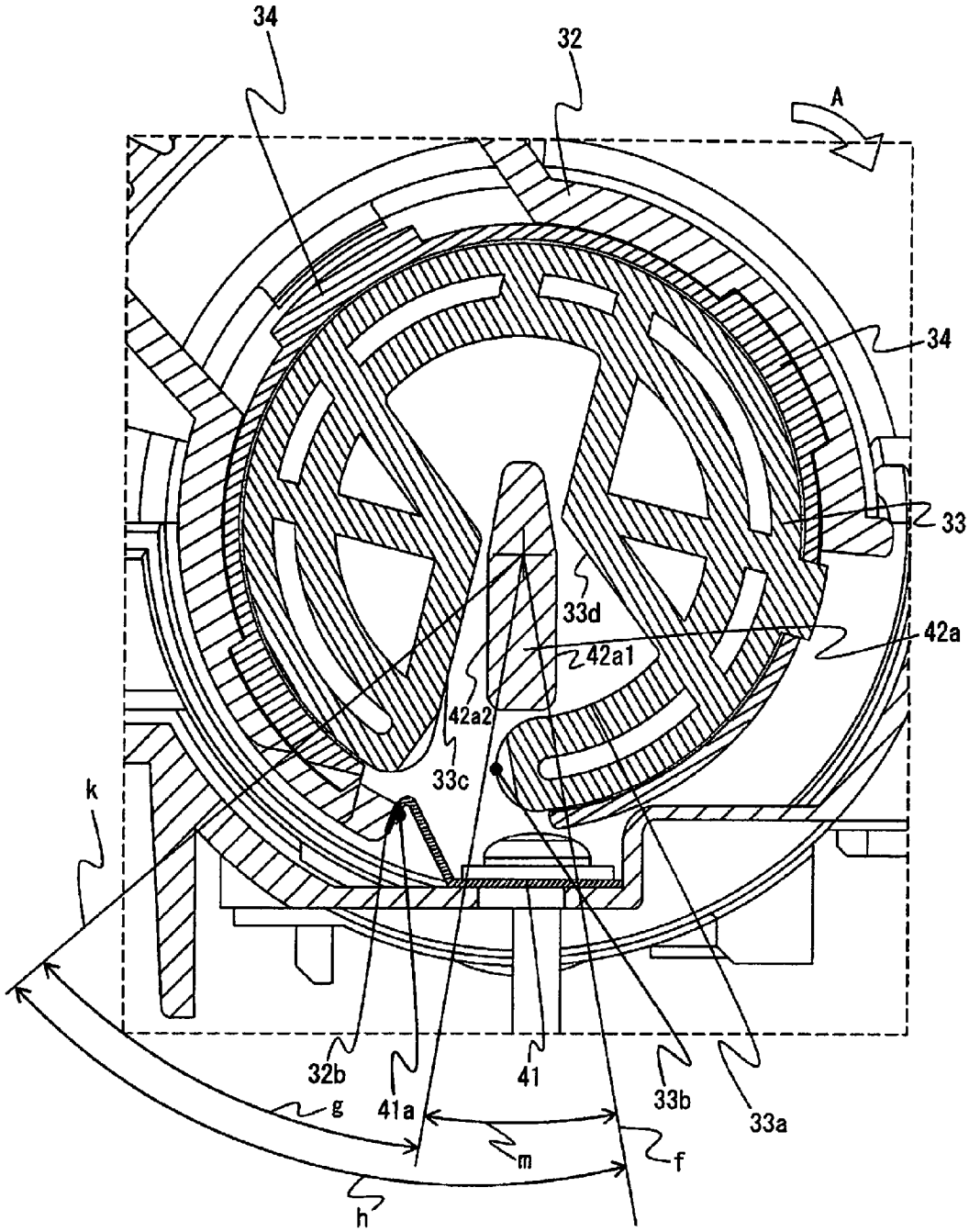
FIG. 19 is an enlarged sectional view of the coupling section, for explaining the detail operation of fixing the developer container to the image formation device.

Next, detailed operation of coupling section 50 is described. FIGS. 18 and 19 are enlarged sectional views of coupling section 50, for explaining the detail operation of fixing developer container 30 to image formation device 40.

FIG. 18 illustrates the state where cap 33 is located in an unengaged position where latch portion 33*a* is not engaged with hook 42*a* yet. FIG. 19 illustrates the state where cap 33 is located in an engaged position where latch portion 33*a* is to be engaged with hook 42*a* and movement of cap 33 is regulated by stopper 41, that is, movement of lever 32 is regulated by stopper 41.

As shown in FIG. 18, when end 33*b* of latch portion 33*a* of cap 33 is located at unengaged position "f" (a rotation start point), latch portion 33*a* is not engaged with hook 42*a* and thus developer container 30 can be detached from image formation device 40. In this state, face 42*a*2 of hook 42*a* is in contact with face 33*c* of cap 33 as shown in FIG. 18.

By rotating lever 32 in arrow direction A, end 33*b* of latch portion 33*a* of cap 33 moves from unengaged position f" shown in FIG. 18 through area "h" (engagement position) including areas "m" and "g" to rotation end point "k" (engaged position) where the rotational movement in arrow direction A is stopped. Note that shutter 34, which is fixed to lever 32, rotates integrally with lever 32 and cap 33.

Next, the relationship between the position of latch end 33*b* and whether supply port 36 of developer 30 is closed or opened by shutter 34 is described below.

As shown in FIG. 18, when end 33*b* of latch portion 33*a* is located at unengaged position "f", latch portion 33*a* and hook 42*a* are not engaged with each other yet, thereby developer container 30 can be detached from image formation device 40.

When latch end 33*b* is located in area "h" after latch end 33*b* is moved away from position "f", hook 42*a* and cap 33 are engaged with each other, that is, image formation device 40 and developer container 30 are engaged with each other.

When latch end 33*b* is within area "m" in area "h", supply port 36 of developer container 30 is completely shut by shutter 34 as shown in FIG. 14. The position where latch end 33*b* is located within area "m" is referred to as the close position.

When latch end 33*b* is within area "g" in area "h", supply port 36 of developer container 30 is not completely shut by shutter 34 and supply port 36 of developer container 30 is partially opened such that toner T is supplied from developer container 30 to image formation device 40.

When latch end 33*b* is at rotation endpoint "k", that is, when face 42*a*1 (see FIG. 19) of hook 42*a* and face 33*d* (see FIG. 19) of cap 33 are in contact with each other as shown in FIG. 16, supply port 36 is completely opened by shutter 34 as shown in FIG. 17, which is referred to as the open position.

Next, the manner of regulating the movement of lever 32 (which is, the movement of cap 33 and shutter 34) by means of stopper 41 is described below with reference to FIG. 19.

When lever 32 is rotated by a predetermined angle in arrow direction A after developer container 30 is joined to image formation device 40, stopper 41 is elastically released to the state shown in FIG. 19. Then, if lever 23 is tried to be moved in the direction opposite to arrow direction A, propping portion 41*a* of stopper 41 will come in contact with contact face 32*b* (a regulation part) formed at lever 32, thereby regulating the rotational movement of lever 32 in the direction opposite to arrow direction A.

Accordingly, supply port 36 can be opened and closed with shutter 34 with maintaining the coupling between image formation device 40 and developer container 30.

Modifications of the First Embodiment

Figure 20A:
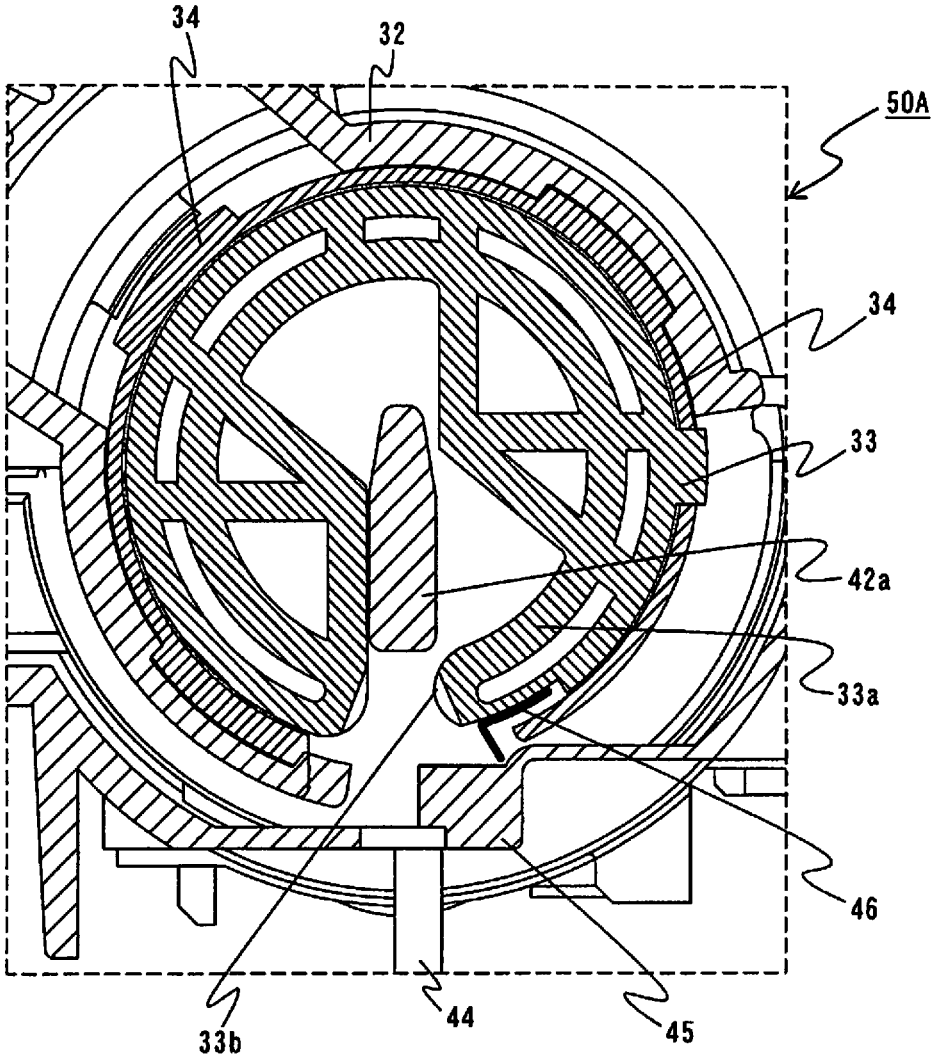
FIG. 20A is an enlarged sectional view illustrating a modification of the coupling section shown in FIG. 1.
Figure 20B:
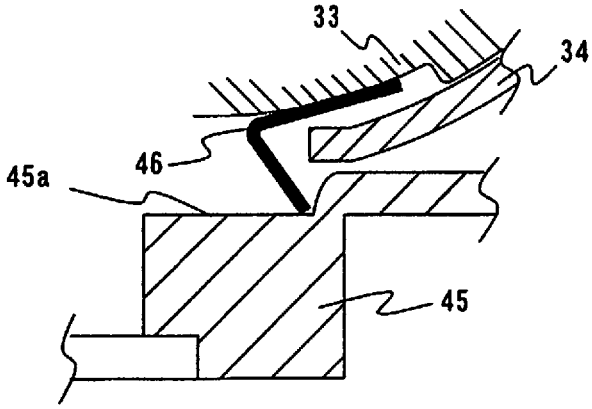
FIG. 20B is an enlarged view of a stopper shown in FIG. 20A.
Figure 21:
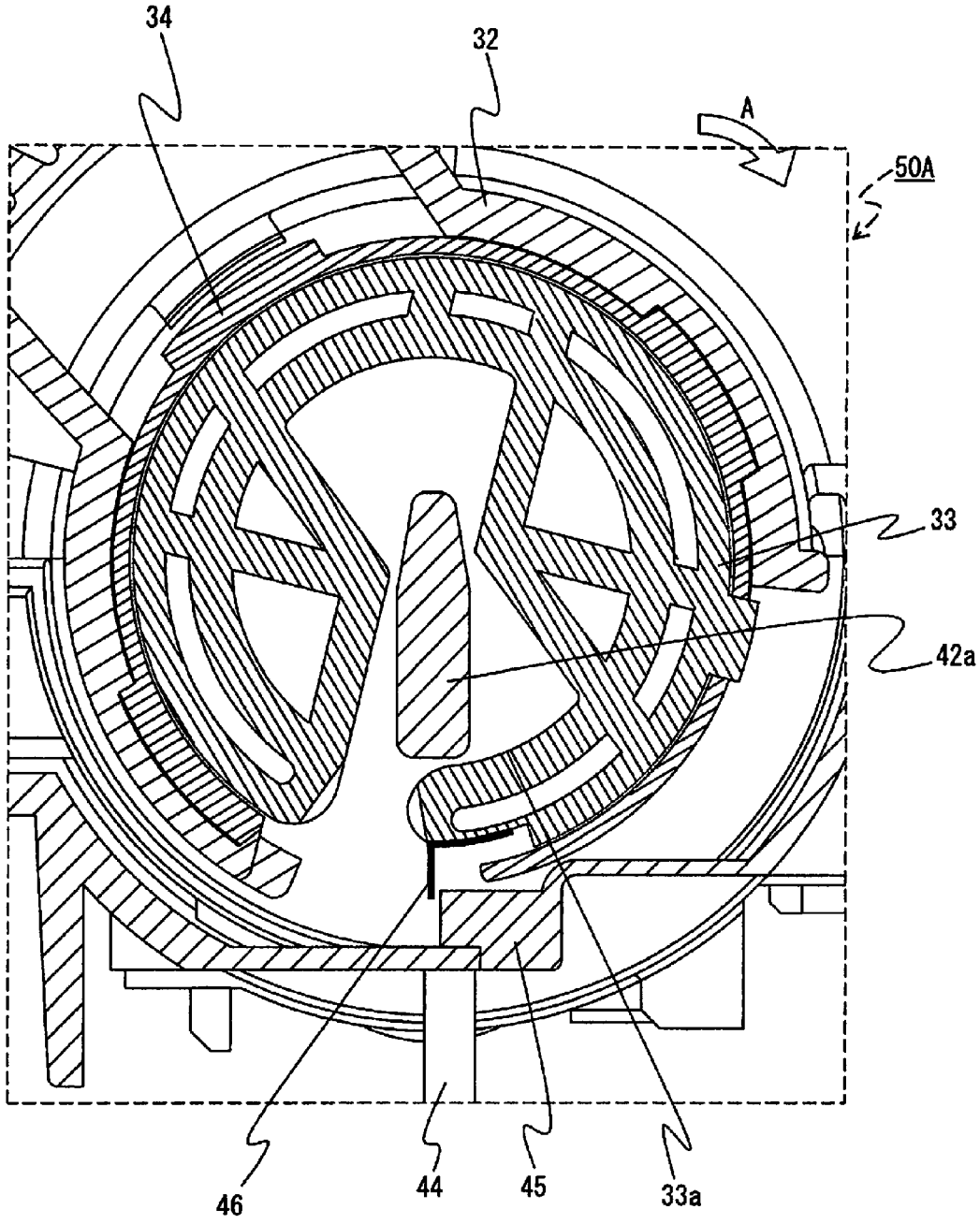
FIG. 21 is an enlarged sectional view illustrating the modification of the coupling section shown in FIG. 1.

FIG. 20A is an enlarged sectional view illustrating a modification of coupling section 50 shown in FIG. 1; and FIG. 20B is an enlarged view illustrating the vicinity of stopper 46 shown in FIG. 20A. FIG. 21 is an enlarged sectional view illustrating the modification of coupling section 50.

Stopper 46 is provided at developer container 30 in this modification as shown in FIGS. 20A, 20B, and 21, although stopper 41 is provided at image formation device 40 in the first embodiment. In the modification, stopper 46 is attached to the bottom of latch portion 33*a* of cap 33 in developer container 30, and catch portion 45 to be engaged with stopper 46 is formed at image formation device 40. Stopper 46 is adhesively attached to the bottom of latch portion 33*a*. FIGS. 20A and 20B illustrate the state where developer container 30 is joined to but not engaged with image formation device 40. In FIGS. 20A and 20B, stopper 46 is elastically deformed by being in contact with face 45*a* of catch portion 45. In FIG. 21, which illustrates the state where cap 33 is rotated by a predetermined amount from the state shown in 20A, stopper 46 is released from face 45*a* of catch portion 45 and elastically returned to the original shape. In this state, if cap 33 is tried to be rotated in the direction opposite arrow A, stopper 46 will be engaged with catch portion 35 so as to prevent cap 33 from rotating in the opposite direction to arrow A.

Effects of the First Embodiment

Image formation unit 20 and the image formation apparatus according to the first embodiment achieve the following effects (1) to (5).

(1) After lever 32 is rotated to engage hook 42*a* with cap 33 in the state where developer container 30 is joined to image formation device 40 in place, stopper 41 regulates the rotational movement of lever 32 to maintain the engagement between hook 42*a* and cap 33. Developer container 30 thus cannot be detached from image formation device 40.

This prevents toner T that is attached to supply port 36 of developer container 30 from scattering to the outside of developer container 30, thereby preventing toner T from attaching to documents, preventing toner T from being attached to image formation device 40 and then falling on documents or printed materials, or preventing toner T from being attached to a part (such as photosensitive drum 21) other than a toner chamber in image formation device 40 and then smearing printed materials.

Further, since developer container 30 cannot be detached from image formation device 40 by means of stopper 41, the manufacturer can ship image formation unit 20 which is an integrated unit of image formation device 40 and developer container 30 as a consumable supply. The manufacturer also can ship image formation device 40 or developer container 30 as a consumable supply, without coupling them.

(2) Stopper 41 is fixed to image formation unit 20 (image formation device 40 in this example) by means of screw 44 so that stopper 41 is detachable from image formation unit 20. In the case where stopper 41 is detached (in the case where there is no stopper), developer container 30 and image formation device 40 can be disengaged from each other, that is, developer container 30 can be detached from image formation device 40. Therefore, by selecting whether to install stopper 41 or not install stopper 41, the manufacturer ships either image formation unit 20 wherein developer container 30 is detachable from image formation device 40 or image formation unit 20 wherein developer container 30 is undetectable from image formation device 40.

(3) Even though developer container 30 has different sizes or shapes depending on the toner capacity thereof, developer container 30 of each size or shape can be fixed to image formation device 40 by using commoditized stopper 41, hook 42*a*, and cap 33, as common parts.

(4) In the first embodiment, upper cover 42 is resin and stopper 41 is metal, such as a stainless-steel plate, which has a higher strength than the resin. Therefore, metal stopper 41 has a higher strength compared to the case where resin stopper 41 is formed integrally with resin upper cover 42 (the case where stopper 41 is made of resin). That is, stopper 41 has enough strength to receive a stronger force from lever 32.

(5) In the first embodiment, arc curve portion 41*b* of metal stopper 41 fixed to upper cover 42 of image formation device 40 is in slide-contact with the outer circumferential surface of cap 33 when cap 33 is rotated. With this simple structure, stopper 41 can slide smoothly over cap 33.

In contrast, in the above described modification, stopper 46 is provided at developer container 30 having cap 33, which slidingly rotates. In the modification, if stopper 46 is fixed to the developer container by a screw, stopper 46 should be mounted considering the rotational track of cap 33, for example, providing the head of the screw out of the rotational track of cap 33. Therefore, it is difficult to provide stopper 46 at developer container 30 by means of a screw which provides a simple, strong attachment.

Thus, in view of the mount position of the stopper and the strength of the stopper against a force, the first embodiment wherein the stopper is provided at image formation device 40 is superior to the modification wherein the stopper is provided at developer container 30. This is because the stopper is provided at immobile image formation device 40 but not provided at mobile cap 33.

[Second Embodiment]

(Configuration of the Second Embodiment)

Figure 22:
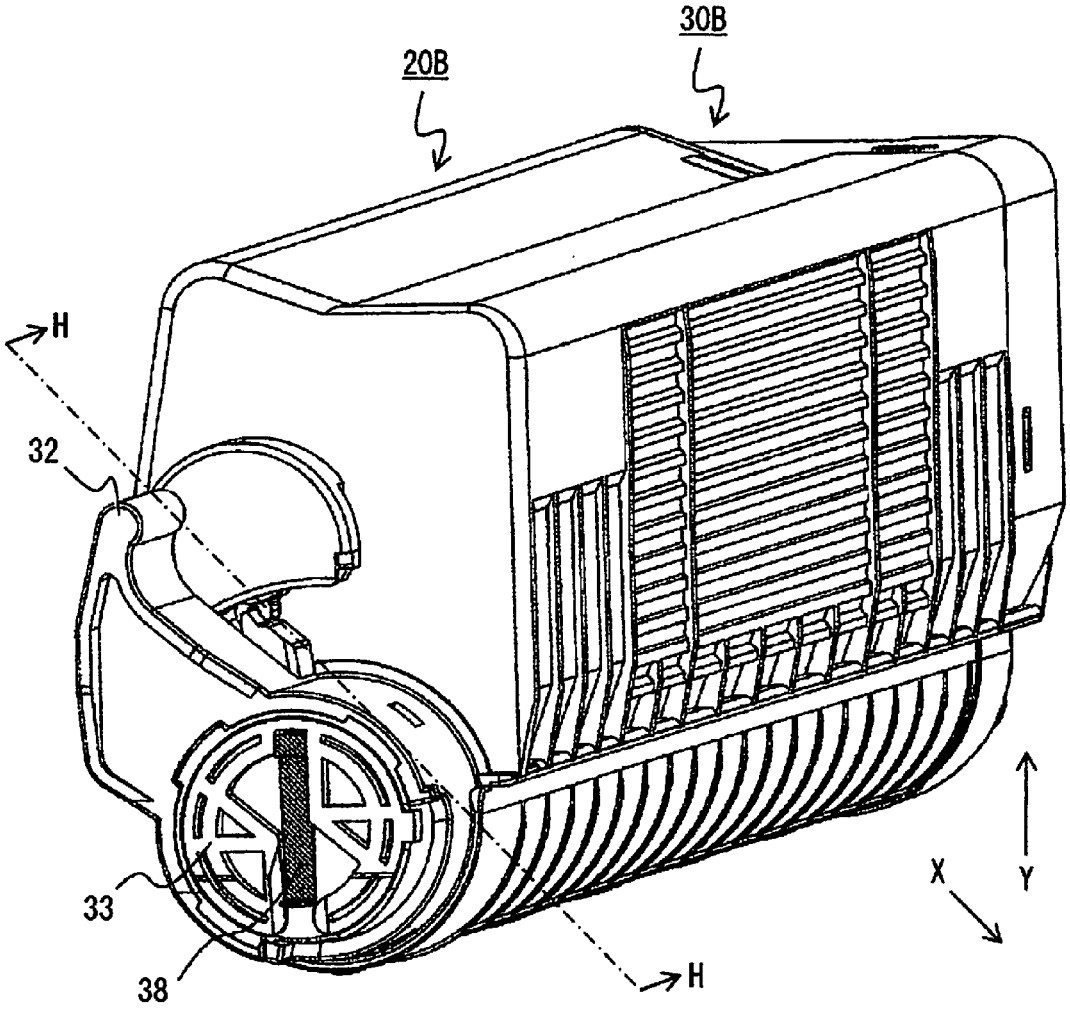
FIG. 22 is a perspective view schematically illustrating an image formation unit according to a second embodiment.
Figure 23:
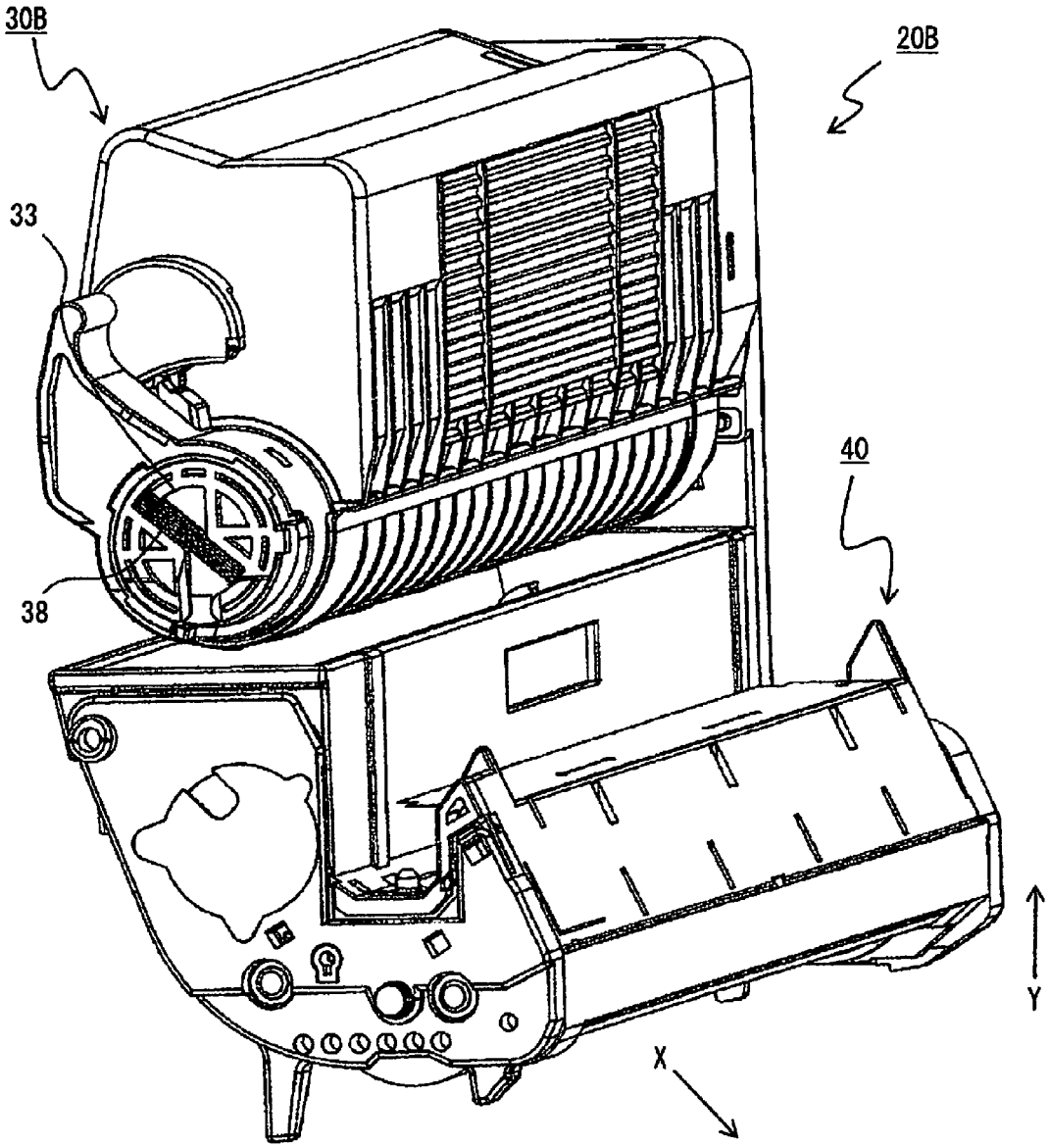
FIG. 23 is a perspective view schematically illustrating an image formation unit in the state before a developer container is joined to an image formation device according to the second embodiment.
Figure 24:
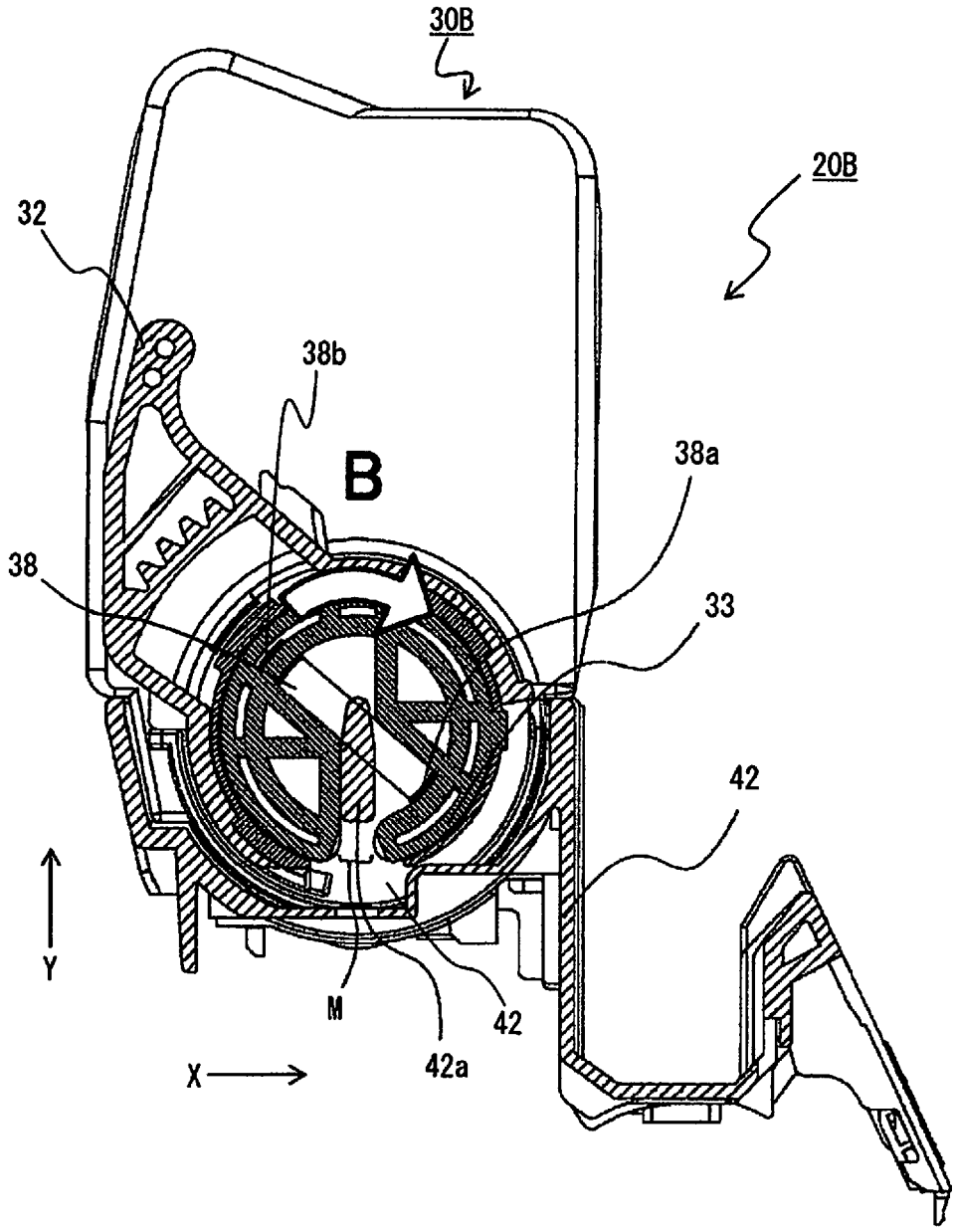
FIG. 24 is a sectional view, along line H-H in FIG. 22, schematically illustrating the image formation unit just after the developer container and the image formation device are joined to each other (that is, in the state where the developer container and the image formation device are joined to each other but not fixed with each other).

FIG. 22 is a perspective view schematically illustrating image formation unit 20B according to the second embodiment. FIG. 23 is a perspective view schematically illustrating image formation unit 20B shown in FIG. 22 in the state before developer container 30B and image formation device 40 are joined to each other. FIG. 24 is a sectional view, along Line H-H in FIG. 22, illustrating image formation unit 20B in the state just after developer container 30B and image formation device 40 are joined to each other (that is, in the state where the developer container 30B and image formation device 40 are joined to each other but not fixed with each other yet).

Note that, in order to easily explain the state where developer container 30B is fixed to image formation device 40, image formation device 40 is not illustrated in FIG. 22.

Image formation unit 20B of the second embodiment includes image formation device 40 having the same configuration as in the first embodiment and developer container 30B having a configuration different from the first embodiment. The second embodiment includes lock member 38 at developer container 30B, which is not provided in the first embodiment, whereas the second embodiment does not include stopper 41 and screw 44, which are provided in the first embodiment. The other configurations of developer container 30B are the same as in developer container 30 of the first embodiment.

As shown in FIGS. 22 and 23, lever 32 and cap 33 are provided at one longitudinal end of image formation device 40 (the right end portion of image formation device 40 as seen in sheet conveyance direction X). Lock member 38 is attached to cap 33. Lock member 38 is formed of a stainless steel plate.

Operation of the Second Embodiment

Figure 25:
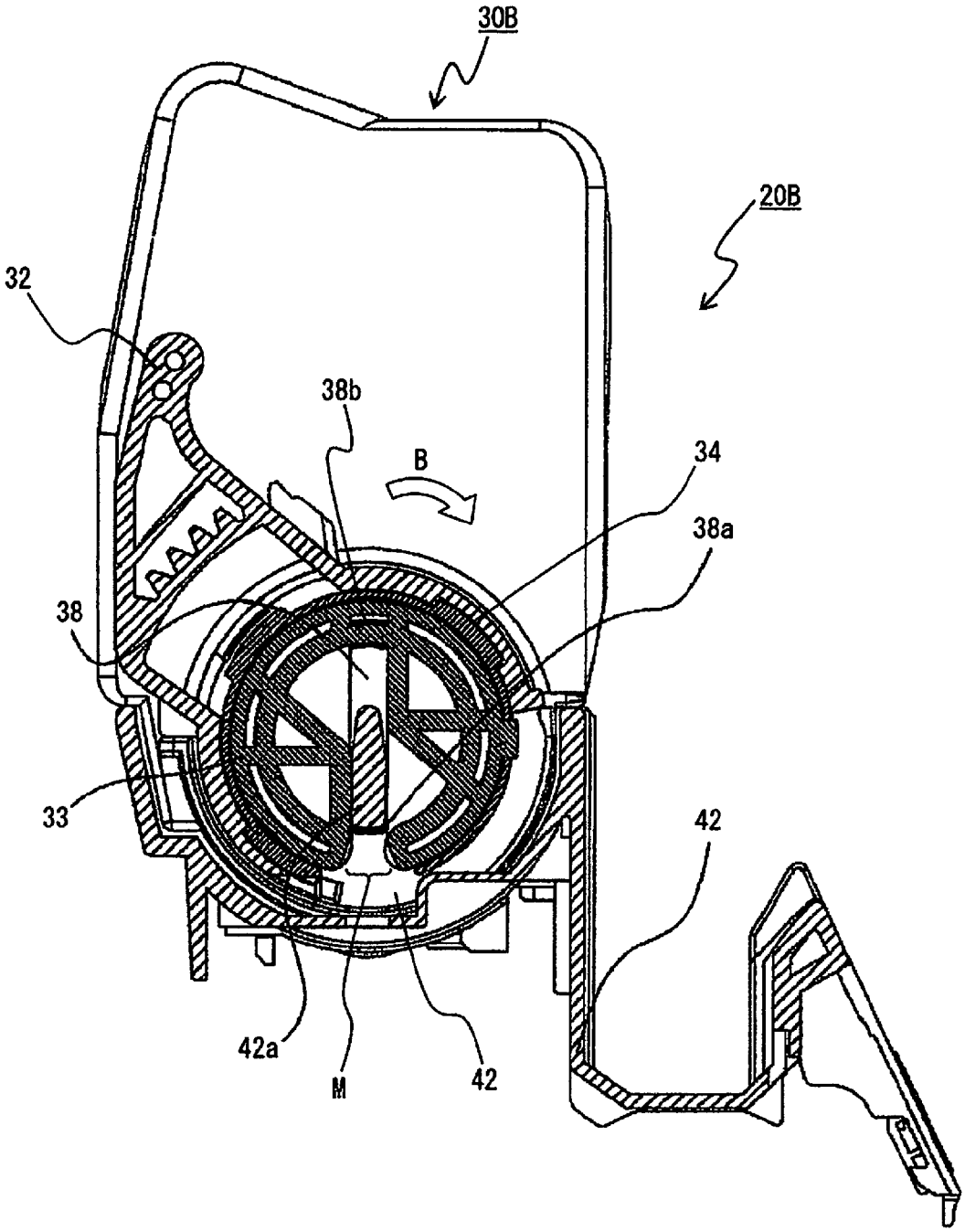
FIG. 25 is a sectional view, along line H-H in FIG. 22, schematically illustrating the image formation unit in the state where the developer container is fixed to the image formation device.
Figure 26:
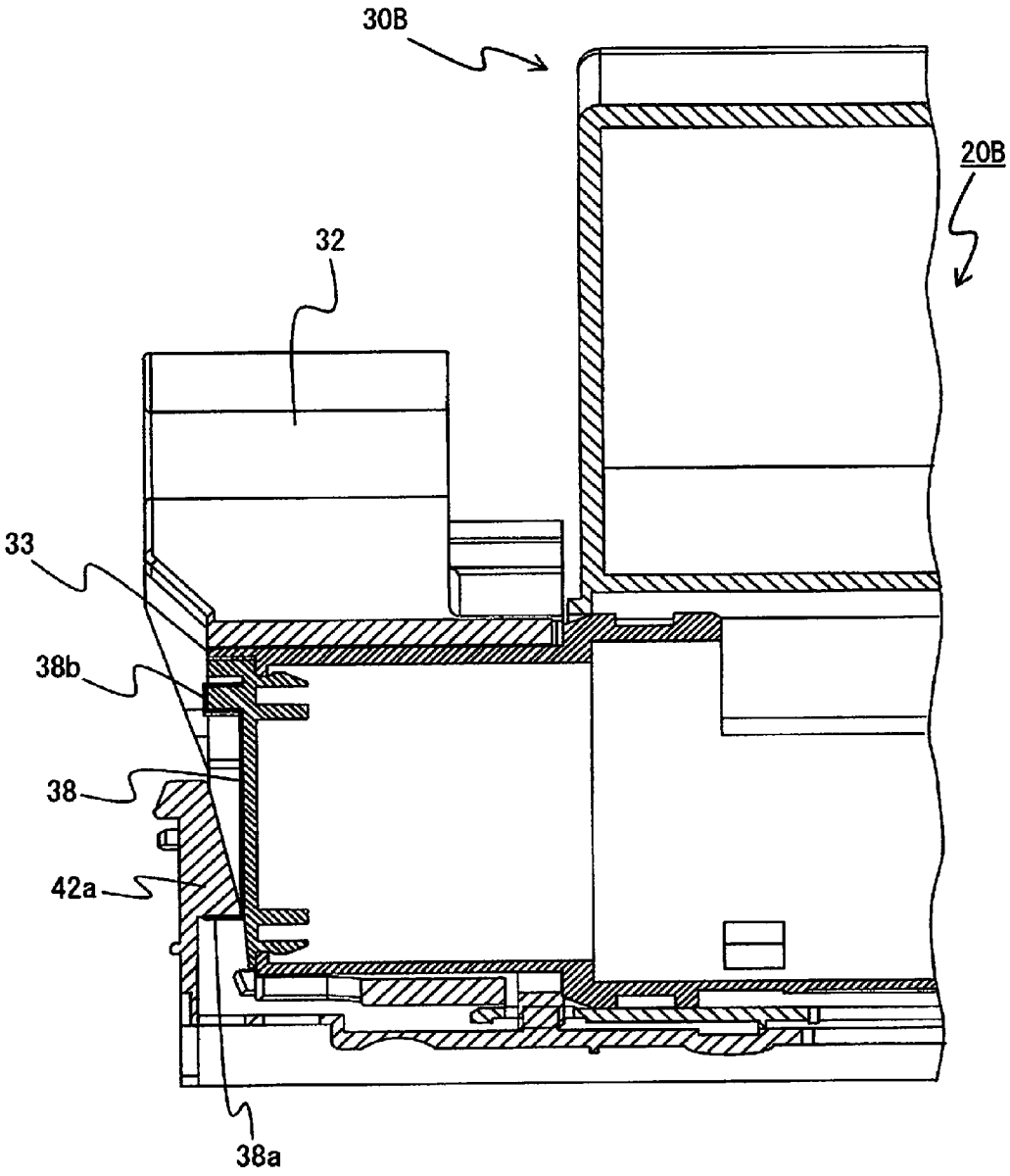
FIG. 26 is a sectional view of the image formation unit, along the longitudinal direction thereof, in the state where the developer container is fixed to the image formation device.

FIG. 25 is a sectional view, taken along Line H-H in FIG. 22, schematically illustrating image formation unit 20 in the state where developer container 30B is fixed to image formation device 40. FIG. 26 is a sectional view of image formation unit 20, taken along the longitudinal direction thereof, in the state where developer container 30B is fixed to image formation device 40.

Before developer container 30 is joined to image formation device 40, which is illustrated in FIG. 23, lock member 38 has been detachably attached to cap 33. First, in the state shown in FIG. 23, the manufacturer puts developer container 30B and image formation device 40 together, as shown in FIG. 24.

In the state shown in FIG. 24, lock member 38 has been attached to cap 33 along ribs of cap 33. Upper end 38*b* of lock member 38 has a U-shape or a C-shape (see FIG. 26) and is fit to a rib of cap 33.

Next, the manufacturer detaches lock member 38 from cap 33, rotates lock member 38 by a predetermined amount from the initial position shown in FIG. 24 in the direction of arrow B, and attaches lock member 38 to cap 33 at a position shown in FIGS. 25 and 26. With this, face 38*a* of lock member 38 is engaged with hook 42*a* of upper cover 42, thereby developer container 30B and image formation device 40 are fixed to each other and cannot be detached from each other, at one longitudinal end of image formation unit 20 (the right end of image formation unit 20 as seen in sheet conveyance direction X).

Note that, at the other longitudinal end of image formation unit 20 (the left end of image formation unit 20 as seen in sheet conveyance direction X), discharge port 43 of image formation device 40 and recovery port 31 of developer container 30B are fit to each other. Thereby developer container 30B and image formation device 40 are fixed to each other and cannot be detached from each other, like the first embodiment.

Fixing operation in the second embodiment is executed as follows.

(S01): First, the manufacturer puts developer container 30B and image formation device 40 together in place in the state where lock member 38 is located at a first position shown in FIGS. 23 and 24.

(S02): Next, the manufacturer detaches lock member 38 from cap 33, rotates lock member 38 in the direction of arrow B shown in FIG. 24 by a predetermined amount, and attaches lock member 38 to cap 33 at a second position shown in FIGS. 25 and 26. With this, lock member 38 close gap M, in the state where hook 42*a* is not engaged with latch portion 33*a* of cap 33 (in the state where latch end 33*b* of cap 33 is located at unengaged position "f"). That is, in the state where hook 42*a* is not engaged with latch portion 33*a* of cap 33, face 38*a* of lock member 38 is on an extension of the inner circumferential surface of latch portion 33*a* of cap 33, thereby hook 42*a* is engaged with lock member 38 that is attached to cap 33 and thus developer container 30B and image formation device 40 are fixed to each other.

In other words, in the entire area where lever 32 can rotate, image formation device 40 and developer container 30B are engaged with each other and cannot be detached from each other. Therefore, while keeping the engagement between image formation device 40 and developer container 30B, supply port 36 can be opened and closed by rotating lever 32 together with shutter 34.

In this state, image formation unit 20 which is an integrated combination of developer container 30B and image formation device 40 may be shipped.

Image formation unit 20 that is manufactured as described above may be manipulated by the user as follows.

(S1): The user rotates lever 32 in the direction of arrow B, which rotates shutter 34 and cap 33 retaining lock member 38 thereon in the direction of arrow B together. This opens supply port 36 with shutter 34 and thus supplies toner T from developer container 30B to image formation device 40.

Note that if the user wants to need only developer 30B or image formation device 40, the manufacturer can ship developer container 30B or image formation device 40 without steps (S01) and (S02).

Effects of the Second Embodiment

Image formation unit 20 and the image formation apparatus according to the second embodiment achieve the following effects (6) to (9).

(6) After manually rotating lock member 38, face 38*a* of lock member 38 is engaged with hook 42*a* of upper cover 42, thereby developer container 30B and image formation device 40 are fixed to each other and cannot be detached from each other. This prevents toner T that is attached to supply port 36 of developer container 30B from scattering to the outside of developer container 30B, thereby preventing toner T from being attached to cloths of the user, documents, or the like, preventing toner T from being attached to image formation device 40 and then falling on printed materials or the like, or preventing toner T from being attached to a part (such as photosensitive drum 21) other than the toner chamber in image formation device 40 and then smearing printed materials or the like.

(7) According to the second embodiment, without rotating lever 32, developer container 30B and image formation device 40 are fixed to each other with lock member 38. In contrast, in the first embodiment, the user or the manufacturer needs to rotate lever 32 to fix developer container 30 to image formation device 40. Thus, in the first embodiment, if the user or the manufacturer excessively rotates lever 32, supply port 40 of developer container 30B might be opened unintentionally. However, in the second embodiment, there is no need to rotate lever 32 to fix developer container 30B to image formation device 40. Thus, there are no worries in the second embodiment that supply port 40 of developer container 30B is opened unintentionally and toner T is then supplied to image formation device 40, which might cause toner T to leak from image formation device 40 during the delivery of image formation unit 20.

(8) In the case where lock member 38 is not attached, developer container 30B and image formation device 40 are not fixed to each other at the unengaged position. Therefore, depending on whether to install lock member 38 or not, the user or the manufacturer can select whether developer container 30B and image formation device 40 are detachable or not.

(9) Even though developer container 30B has different sizes or shapes depending on the toner capacity thereof, developer container 30B of each size or shape can be fixed to image formation device 40 by using hook 42*a*, cap 33, and lock member 38, as common parts.

(Other Modification)

The invention is not limited to the above-described embodiments and modifications, but various other forms of use and modifications are possible, which may include the following examples (a) to (c).

(a) The descriptions of the first and second embodiments are based on the case where the image formation apparatus is a color page printer. The invention, however, is not limited to such a case. The image formation apparatus according to the invention may includes a monochrome printer, a facsimile machine, a copy machine, a MFP (multifunction printer/product/peripheral), and the like.

(b) Stopper 41 in the first embodiment and lock member 38 in the second embodiment are both formed of stainless steel plate having a spring property. The invention, however, is not limited to this. For example, stopper 41 and lock member 38 may be made of an engineering plastic having a high elastic coefficient.

(c) In the first embodiment, when latch end 33*b* is located at point "f" shown in FIG. 18, developer container 30 and image formation device 40 can be detached from each other. The invention, however, is not limited to this. For example, in a modification, developer container 30 and image formation device 40 may be detachable from each other when latch end 33*b* is located within a certain area.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation unit comprising:

a developer container containing developer;

an image formation device configured to form a developer image using the developer;

a first engagement part provided at the image formation device;

a second engagement part movably provided at the developer container, the second engagement part being movable between an unengaged position and an engaged position with respect to the first engagement part;

a regulation part movably provided at the developer container such that the second engagement part and the regulation part move together; and a regulation member fixed to the image formation device and configured, when the second engagement part is in the engaged position after the second engagement part is moved from the unengaged portion to the engaged position, to come into contact with the regulation part and thereby regulate movement of the second engagement part, wherein the regulation member is formed of a folded plate member such that the regulation member includes:

an elastic portion configured to come into contact with the developer container; and a stationary portion fixed to the image formation device.

2. The image formation apparatus according to claim 1, wherein the developer container can be attached to and detached from the image formation device when the second engagement part is in the unengaged position, when the second engagement part is moved from the unengaged position to the engaged position in a first direction in the state where the developer container is attached to the image formation device, the first and second engagement parts are engaged with each other such that the developer container cannot be detached from the image formation device, and the regulation member prevents the second engagement part from moving into the unengaged position from the engaged position in a second direction opposite to the first direction so as to prevent the developer container from being detached from the image formation device.

3. The image formation apparatus according to claim 2, further comprising a manipulation part that moves the second engagement part, wherein the manipulation part includes a first contact part and a second contact part, the second contact part comprising the regulation part, the regulation member includes a contact part, and the first contact part of the manipulation part is in contact with the contact part of the regulation member in the state where the second engagement part is in the unengaged position where the developer container can be attached to and detached from the image formation device, whereas the second contact part of the manipulation part is in contact with the contact part of the regulation member in the state where the regulation part prevents the second engagement part from moving from the engaged position into the unengaged position in the second direction.

4. The image formation apparatus according to claim 3, wherein when the second engagement part is moved from the unengaged position into the engaged position in the first direction, the contact part of the regulation member is moved from being in contact with the manipulation part to not being in contact with the first contact part of the manipulation part such that the contact part of the regulation member is moved in a regulation area, and when the second engagement part is moved toward the unengaged position in the second direction in the state where the contact portion of the regulation member is in the regulation area, the contact part of the regulation member comes into contact with the second contact part of the manipulation part to prevent the second engagement part from moving into the unengaged position in the second direction.

5. The image formation apparatus according to claim 4, wherein when the second engagement part is moved in the first direction in the state where the contact portion of the regulation member is in the regulation area, the contact part of the regulation member does not come in contact with either of the first or second contact part of the manipulation part.

6. The image formation apparatus according to claim 4, wherein the regulation member is formed of a elastic member, when the second engagement part is moved from the unengaged position to the engaged position in the first direction and then the contact part of the regulation part is moved from being in contact with the manipulation part to not being in contact with the first contact part of the manipulation part, the regulation member is elastically deformed such that the contact part of the regulation member is moved in the regulation area where the contact part of the regulation member can come into contact with the second contact part of the manipulation part.

7. The image formation unit according to claim 1, wherein the regulation member is provided at a position of the image formation device that is opposite to a bottom portion of the developer container upon attachment of the developer container to the image formation device.

8. An image formation unit comprising:

a developer container containing developer;

an image formation device configured to form a developer image using the developer;

a first engagement part provided at the image formation device;

a second engagement part movably provided at the developer container, the second engagement part movable between an unengaged position wherein the second engagement part is not engaged with the first engagement part when the image formation device and the developer container are attached to each other in place and an engaged position wherein the second engagement part is engaged with the first engagement part when the image formation device and the developer container are attached to each other in place;

a regulation part movably provided at the developer container such that the second engagement part and the regulation part move together; and a regulation member fixed to the image formation device and configured to allow the second engagement part to move within the engaged position and to prevent the second engagement part from moving from the engaged position to the unengaged position, due to the regulation member being in contact with the regulation part, wherein the regulation member is formed of a folded plate member such that the regulation member includes:

an elastic portion configured to come into contact with the developer container; and a stationary portion fixed to the image formation device.

9. The image formation unit according to claim 8, wherein the regulation member allows the second engagement part to move from the unengaged position to the engaged position and prevents the second engagement part from moving from the engaged position to the unengaged position.

10. The image formation unit according to claim 8, wherein the developer container further comprises: an opening for the developer to pass to the image formation device; and a shield member movable from a closed position wherein the shield member closes the opening of the developer container to an open position wherein the shield member opens the opening of the developer container, and the second engagement part moves in association with the movement of the shield member.

11. The image formation unit according to claim 10 wherein the second engagement part is fixed to the shield member.

12. The image formation unit according to claim 8 wherein the developer container further comprises a manipulation part that moves the second engagement part.

13. The image formation unit according to claim 10 wherein, the regulation member allows the shield member to move from the open position to the closed position.

14. The image formation unit according to claim 8 wherein the regulation member is provided to the image formation device.

15. The image formation unit according to claim 14 wherein the regulation member is detachable from the image formation device.

16. The image formation apparatus according to claim 8, wherein the developer container can be attached to and detached from the image formation device, when the second engagement part is in the unengaged position, when the second engagement part is moved from the unengaged position to the engaged position in a first direction in the state where the developer container is attached to the image formation device, the first and second engagement parts are engaged with each other such that the developer container cannot be detached from the image formation device, and the regulation member prevents the second engagement part from moving into the unengaged position from the engaged position in a second direction opposite to the first direction so as to prevent the developer container from being detached from the image formation device.

17. The image formation apparatus according to claim 16, further comprising a manipulation part that moves the second engagement part, wherein the manipulation part includes a first contact part and a second contact part, the second contact part comprising the regulation part, the regulation member includes a contact part, and the first contact part of the manipulation part is in contact with the contact part of the regulation member in the state where the second engagement part is in the unengaged position where the developer container can be attached to and detached from the image formation device, whereas the second contact part of the manipulation part is in contact with the contact part of the regulation member in the state where the regulation part prevents the second engagement part from moving from the engaged position into the unengaged position in the second direction.

18. The image formation apparatus according to claim 17, wherein when the second engagement part is moved from the unengaged position into the engaged position in the first direction, the contact part of the regulation member is moved from being in contact with the manipulation part to not being in contact with the first contact part of the manipulation part such that the contact part of the regulation member is moved in a regulation area, and when the second engagement part is moved toward the unengaged position in the second direction in the state where the contact portion of the regulation member is in the regulation area, the contact part of the regulation member comes into contact with the second contact part of the manipulation part to prevent the second engagement part from moving into the unengaged position in the second direction.

19. The image formation apparatus according to claim 18, wherein when the second engagement part is moved in the first direction in the state where the contact portion of the regulation member is in the regulation area, the contact part of the regulation member does not come in contact with either of the first or second contact part of the manipulation part.

20. The image formation apparatus according to claim 18, wherein the regulation member is formed of a elastic member, when the second engagement part is moved from the unengaged position to the engaged position in the first direction and then the contact part of the regulation part is moved from being in contact with the manipulation part to not being in contact with the first contact part of the manipulation part, the regulation member is elastically deformed such that the contact part of the regulation member is moved in the regulation area where the contact part of the regulation member can come into contact with the second contact part of the manipulation part.

21. The image formation unit according to claim 8, wherein the regulation member is provided at a position of the image formation device that is opposite to a bottom portion of the developer container upon attachment of the developer container to the image formation device.

* * * * *